US005584346A

United States Patent [19]

Sakamoto et al.

[11] Patent Number: 5,584,346

[45] Date of Patent: Dec. 17, 1996

[54] CONTROL SYSTEM FOR A MOTOR GRADER

[75] Inventors: Masaaki Sakamoto; Tsuneo Kaneko; Masaaki Nishimura, all of Niigata-ken, Japan

[73] Assignees: Komatsu Est Corp.; Kabushiki Kaisha Komatsu Seisakusho, both of Japan

[21] Appl. No.: 90,652

[22] Filed: Jul. 12, 1993

[30] Foreign Application Priority Data

| | | | |
|---|---|---|---|
| Jul. 27, 1992 | [JP] | Japan | 4-199752 |
| Nov. 30, 1992 | [JP] | Japan | 4-320311 |
| Nov. 30, 1992 | [JP] | Japan | 4-320319 |
| Nov. 30, 1992 | [JP] | Japan | 4-320417 |
| Nov. 30, 1992 | [JP] | Japan | 4-320486 |
| Nov. 30, 1992 | [JP] | Japan | 4-320556 |
| Nov. 30, 1992 | [JP] | Japan | 4-320657 |

[51] Int. Cl.[6] ..... E02F 3/76

[52] U.S. Cl. ..... 172/4.5; 172/781; 364/424.07; 37/382

[58] Field of Search ..... 172/4.5, 781; 37/382, 37/414; 364/424.07

[56] References Cited

U.S. PATENT DOCUMENTS

| | | | |
|---|---|---|---|
| H1,191 | 6/1993 | Hutchison et al. | 91/459 |
| 3,703,931 | 11/1972 | Page et al. | 172/4.5 |
| 3,737,003 | 6/1973 | Beals et al. | 180/78 |
| 3,759,333 | 9/1973 | Rivinius | 172/781 |
| 3,896,899 | 7/1975 | Scholl | 172/4.5 |
| 3,965,771 | 6/1976 | MacDonald | 74/479 |
| 4,009,758 | 3/1977 | Tillman | 172/4.5 |
| 4,705,450 | 11/1987 | Gano | 414/687 |
| 4,864,746 | 9/1989 | Fukumoto | 37/414 |
| 4,909,330 | 3/1990 | Kasher et al. | 172/4 |
| 5,002,454 | 3/1991 | Hadank et al. | 414/695.5 |
| 5,092,408 | 3/1992 | Tatara et al. | 172/2 |
| 5,160,239 | 11/1992 | Allen et al. | 172/4.5 X |
| 5,347,448 | 9/1994 | Nam | 37/414 X |

FOREIGN PATENT DOCUMENTS

| | | | |
|---|---|---|---|
| 59-102023 | 6/1984 | Japan . | |
| 9218706 | 10/1992 | Japan | 364/424.07 |
| 4126952 | 11/1992 | Japan . | |

*Primary Examiner*—Terry Lee Melius
*Assistant Examiner*—Victor Batson
*Attorney, Agent, or Firm*—Ronald P. Kananen

[57] ABSTRACT

A motor grader includes a work implement operating device which permits operation of a plurality of direction control valve with reduced number of operation levers. The motor grader includes a wheeled body for traveling and carrying at least one work implement, at least one operation lever operable in a first direction for electrically generating a first operation command signal and a second direction perpendicular to the first direction for generating a second operation command signal and a mode selector selectable at least between a first mode and a second mode for generating a mode selection signal. A controller receives the first and second operation command signals and the mode selection signal for controlling different motor grader functions depending upon an input combination of the first and second operation command signals and the mode selection signal.

21 Claims, 21 Drawing Sheets

CONTROL SYSTEM FOR A MOTOR GRADER

BACKGROUND OF THE INVENTION

1. Field of the Invention

The present invention relates to a motor grader. More specifically, the invention relates to a motor grader with a multi-function operation lever which performs more than one function.

2. Description of the Related Art

A typical example of the conventional motor grader is illustrated in FIGS. 1. In the shown construction, the motor grader is provided with a draw bar 2 swingably mounted on the front end of a vehicle body 1. Left and right lifting cylinders 3 and 4 and a transporting cylinder 5 are connected between the draw bar 2 and the vehicle body 1. A swing circle 6 is mounted on the draw bar 2 for swing motion by means of a hydraulic swing motor 7. A blade 9 is mounted on the swing circle 6 via a bracket 8 of the latter for movement in lateral directions by means of a blade shifting cylinder 10. In addition, a leaning cylinder (not shown) is provided for front wheels 11 for leaning in the lateral directions.

Also, there are various known motor graders. For instance, a motor grader having a scarifier movable in the vertical direction by means of a scarifier cylinder has been known. Furthermore, a motor grader is known having an articulated vehicle body for arcuating by means of a steering cylinder.

In order to control the operations of various cylinders, a hydraulic swing motor and so forth, an output pressure of a hydraulic pump as a hydraulic pressure source is distributed to respective cylinders and the hydraulic motor via direction control valves. For controlling operation of respective direction control valves, a plurality of operation levers are provided in a work implement operating device of the motor grader. One example of the work implement operating device is illustrated in FIG. 2. As can be seen from FIG. 2, a plurality of operation levers which are generally represented by the reference numeral 12, are provided at both sides of a steering wheel 13. Respective operation levers 12 are connected to corresponding direction control valves via a link mechanism. In the example shown in FIG. 2, a right blade lifting operation lever 12*a*, a leaning operation lever 12*b*, and a blade shifting operation lever 12*c* are arranged at the right side of the steering wheel 13, and a draw bar shift operation lever 12*d*, a steering operation lever 12*e*, a swing circle operation lever 12*f*, a scarifier operation lever 12*g* and a left blade lifting operation lever 12*h* are arranged at the left side of the steering wheel 13.

With the operation device set forth above, since a plurality of operation levers are connected to the corresponding direction control valves by means of link mechanisms, the construction becomes complicated. Furthermore, for operating the work implement, one of more operation levers corresponding to a desired behavior of the work implement have to be selected, thus to make an operator's operation complicated. In addition, a plurality of operation levers arranged at both sides of the steering wheel may degrade forward sight.

For example, when the blade 9 is to be lifted or tilted, the left and right blade lifting operation levers 12*a* and 12*h* are operated. Also, when the blade 9 is to be shifted in the lateral direction, the blade shift operation lever 12*c* is operated, and when the swing circle 6 is to be swung, the swing circle operation lever 12*f* is operated. In addition, when the work implement has to be operated while the vehicle is running, the operator is required to operate both the steering wheel 13 and the operation levers 12 by frequently moving the hands between the steering wheel 13 and one more of the operation levers 12.

On the other hand, when the blade 9 is to be pivoted to vary an angle formed between the longitudinal axis of the vehicle body 1 and the blade 9, which angle will be hereafter referred to as a propulsion angle, the relevant operation levers 12 are operated to switch the valve positions of the corresponding direction control valves to drive the hydraulic swing motor 7 to pivot the blade 9 together with the swing circle 6. However, during this operation, the left and right ends of the blade 9 move along an arc so that the lateral positions of the left and right ends of the blade 9 may be differentiated between the positions before and after pivoting. Namely, when the propulsion angle of the blade is varied, the position of the ends of the blade 9 should be varied. This may cause a problem to cause collision of the blade with the shoulder of the road due to a difference in positions of the ends of the blade. To avoid this, it becomes necessary to cause a lateral shift of the blade upon varying the propulsion angle. This clearly requires extra operation for the lateral shifting of the blade to make the operator's operation more complicated.

On the other hand, in the prior art, there has been proposed a blade angle control device to automatically control a blade angle irrespective of variation of tilt angle of the vehicle body and/or the propulsion angle of the blade. The blade angle control device includes a target blade angle setting means, such as a dial, switch or so forth. The blade angle control device is designed to control the blade angle to the target angle set through the target blade angle setting means. For varying the target blade angle, it requires the manual operation of the operator against the target blade angle setting means.

Therefore, such blade angle control device is not applicable for the cases where the left and right cant of tilt angle varies sequentially with curving of the working road, or where the target blade angle has to be varied at the intersection with the other working road, for substantial difficulty occurs in setting or varying the target blade angle an appropriate value by the operator.

Also, when the blade is to be lifted up or down, both of the direction control valves corresponding to left and right lift cylinders 3 and 4 are to be operated. This requires operations of the left and right blade lifting operation levers 12*h* and 12*a*. Then, both hands of the operator are used for operating the left and right blade lifting operation levers 12*h* and 12*a* to make it impossible to operate the steering wheel 13. In addition, during lifting up and down of the blade 9, the blade may cause lateral shifting due to presence of the lateral feeding cylinder 5. Therefore, the operation of the lateral feeding cylinder 5 is further required to make the operator's operation more complicated in the extent that a qualified operator is required for performing the operation set forth above.

SUMMARY OF THE INVENTION

In view of various defects in the prior art, it is an object of the present invention to overcome problems in the prior art.

More specifically, an object of the present invention is to provide a work implement operating device which permits operation of a plurality of direction control valves with a reduced number of operation levers, which reduced number of operation levers will contribute to provide better forward sight to the operator.

Another object of the present invention is to provide a steering system for a road grader which permits steering operation of the vehicle without a steering wheel.

A further object of the present invention is to provide a blade pivoting system which can perform pivotal motion of the blade without varying the positions of the left and right side ends of the blade.

A still further object of the present invention is to provide a blade angle control system which permits variation of a blade angle irrespective of a target blade angle.

A yet further object of the present invention is to provide a blade lifting system which permits operation of left and right lifting cylinders and of the lateral feeding cylinder with a single operation lever.

A still further object of the present invention is to provide a blade lifting system which permits a lifting operation for one side of the blade while maintaining the other end at a constant level.

In order to accomplish the above-mentioned and other objects, according to a first aspect of the invention, an operation system for a motor grader including a plurality of hydraulic actuators for performing various functions and a plurality of valve means respective corresponding the actuators for controlling operation of the latter, comprises:

left and right operation levers provided within an operator cabin of the motor grader and operable in arbitrary directions for outputting operation command signals indicative of the operated directions;

a selector switch: and a controller receiving the operation command signals from the left and right operation levers having values proportional to operation strokes thereof, and a select signal from the selector switch, the controller generating operation control signals to be supplied to at least one of the valve means corresponding to the operated direction represented by the operation command signal from one of the left and right operation levers, which operation control signal is supplied to different valve means depending upon the selection signal.

In the preferred construction, the left and right operation levers are operable in a back and forth direction and a left and right direction for producing the operation command signals representative of the operated direction and having a value proportional to the operation stroke. Each of the valve means comprises an electromagnetic proportioning valve, and the controller selects a work implement to be operated among a plurality of work implements carried by the motor grader on the basis of the operation command signals and the selection signal to output the operation control signals to the corresponding valve means.

According to a second aspect of the invention, an operation system for a motor grader including a plurality of hydraulic actuators for performing various functions and a plurality of valve means respectively corresponding the actuators for controlling operation of the latter, comprises:

left and right operation levers provided within an operator cabin of the motor grader and operable in arbitrary directions for outputting operation command signals indicative of the operated directions, the left operating lever being assigned for controlling a vehicular driving function and the right operation lever being assigned for controlling functions of work implements carried by the motor grader;

a selector switch; and a controller receiving the operation command signals from the left and right operation levers having values proportional to operation strokes thereof, and a select signal from the selector switch, the controller generating operation control signal to be supplied to at least one valve means for at least one actuator for controlling vehicular driving behavior in response to the operation command signal from the left operation lever and for at least one of the actuators controlling operation of one of the work implements in response to the operation command signal from the right operation lever.

In this case, the left and right operation levers are operable in a back and forth direction and a left and right direction for producing the operation command signal representative of the operated direction and having a value proportional to the operation stroke. Each of the valve means comprises an electromagnetic proportioning valve, and the controller selects a work implement to be operated from among a plurality of work implements carried by the motor grader on the basis of the operation command signal from the right operation lever and the selection signal to output the operation control signal to the corresponding valve means.

According to a third aspect of the invention, a blade swing control system for a motor grader, in which a swing circle is mounted on a draw bar mounted on a vehicle body, for swing motion by means of a hydraulic swing motor, and a blade is mounted on the swing circle for lateral movement by means of a shift cylinder, comprises:

an operation lever operable at least in a back and forth direction and a left and right direction for generating an operation command signal representative of the operated direction and the operation stroke thereof;

a first electromagnetic proportioning valve for controlling pressure supply for the hydraulic swing motor;

a second electromagnetic proportioning valve for controlling pressure supply for the shift cylinder;

means for detecting a swing angle of the blade;

means for deriving lateral shifting magnitude of the blade; and a controller for operating the first and second electromagnetic proportioning valves so that the second electromagnetic proportioning valve supplies a hydraulic pressure to the shift cylinder for causing lateral shifting of the blade in a magnitude corresponding to swing angle of the blade in conjunction with driving of the hydraulic swing motor for swinging the blade over an angle indicated by a swing angle commanded through the operation lever.

According to a fourth aspect of the invention, a control system for controlling a tilt angle of a blade of a motor grader, comprises:

an operation lever operable in an arbitrary direction to generate an operation command signal representative of the operated direction and the operation magnitude thereof;

left and right lifting cylinders for lifting up and down the blade;

means for detecting propulsion angle of the blade;

means for setting a target blade tilt angle;;

first and second electromagnetic proportioning valves for controlling pressure supply for the left and right lift cylinders; and a controller for controlling the first and second electromagnetic proportioning valves on the basis of the target blade tilt angle and the blade propulsion angle in response to the operation of the operation lever in a first direction and for controlling the first and second electromagnetic proportioning valves for varying the tilt angle of the blade depending upon the operation command signal and updating the target blade tilt angle in response to the operation of the operation lever in a second direction different from the first direction.

According to a fifth aspect of the invention, a blade lifting control system for a motor grader including a draw bar supported on a vehicle body by means of left and right lifting cylinders for vertical swing motion, and a lateral feeding cylinder disposed between the draw bar and the vehicle body, comprises:

an operation lever operable in a back and forth direction for generating an operation command signal representative of the operated direction and the operation stroke;

a first electromagnetic proportioning valve for controlling pressure supply for the left lifting cylinder;

a second electromagnetic proportioning valve for controlling pressure supply for the right lifting cylinder;

a third electromagnetic proportioning valve for controlling pressure supply for the lateral feeding cylinder; and a controller for outputting operation control signals to the first, second and third electromagnetic proportioning valves in response to the operation command signal from the operation lever.

According to a sixth aspect of the invention, a blade lifting control system for a motor grader including a draw bar supported on a vehicle body by means of left and right lifting cylinders for vertical swing motion, and a blade being mounted on the draw bar, comprises:

an operation lever operable in a back and forth direction for generating an operation command signal representative of the operated direction and the operation stroke;

a first electromagnetic proportioning valve for controlling pressure supply for the left lifting cylinder;

a second electromagnetic proportioning valve for controlling pressure supply for the right lifting cylinder; and a controller responsive to the operation command signal from the operation lever for operating the first and second electromagnetic proportioning valves for establishing first and second fluid path areas in the first and second electromagnetic proportioning valves in a mutually independent manner.

According to a seventh aspect of the invention, a motor grader comprises:

a wheeled body for traveling and carrying at least one work implement;

at least one operation lever operable in a first direction for electrically generating a first operation command signal and a second direction perpendicular to the first direction for generating a second operation command signal;

a mode selector selectable at least between a first mode and a second mode for generating a mode selection signal; and a controller receiving the first and second operation command signals and the mode selection signal for controlling different motor grader functions depending upon an input combination of the first and second operation command signals and the mode selection signal.

The controller may control a first motor grader function in response to the first operation command signal input while the mode selection signal is held at the first mode and a second motor grader function in response to the second operation command signal input while the mode selection signal is held at the first mode, a third motor grader function in response to the first operation command signal input while the mode selection signal is held at the second mode and a fourth motor grader function in response to the second operation command signal input while the mode selection signal is held at the first mode. The operation lever may be further operable in further directions oblique to the first and second directions, and the controller is responsive to the operation command signal from the operation lever as operated in one of a plurality of operating directions to control one of the motor grader functions unique to those to be controlled by the operation of the operation lever in any other directions.

In the preferred construction, the controller may control a first motor grader function to be performed by a first component of the motor grader in response to the first operation command signal input while the mode selection signal is held at the first mode and a second motor grader function to be performed by a second component different from the first component in response to the second operation command signal input while the mode selection signal is held at the first mode, a third motor grader function to be performed by a third component different from the first and second components in response to the first operation command signal input while the mode selection signal is held at the second mode and a fourth motor grader function to be performed by a fourth component different from the first, second and third components in response to the second operation command signal input while the mode selection signal is held at the first mode. In this case, at least one of the first, second, third and fourth motor grader functions is a composite function of a plurality of motor grader components including the corresponding one of the first, second, third and fourth components and at least one auxiliary component. Preferably, the auxiliary component is cooperative with the one of first, second, third and fourth components for compensating inherent undesirable action associated with operation of the one of first, second, third and fourth components.

In practice, the one of first, second, third and fourth components comprises a hydraulic motor for controlling swing motion of a blade, and the auxiliary component comprises a hydraulic cylinder for causing lateral shift of the blade for compensating lateral displacement inherently caused by swing motion of the blade.

In the alternative, the first function is vehicular traveling in forward and reverse directions and second function is a vehicular steering operation. In such case, the third function may be vehicular traveling in forward and reverse directions which is the same as the first function and the fourth function may be a leaning control function or a vehicular body arcuation control function.

In the further alternative, the controller is provided with a blade tilt angle adjusting function for adjusting a blade tilt angle toward a preset target tilt angle, and the controller is responsive to the first operation command signal from the operation lever while the mode selection signal is held at the first mode to perform automatic control of the blade tilt angle toward the target tilt angle, and to the first operation command signal while the mode selection signal is held at the second mode, to permit interactive blade tilt angle control through the operation lever for updating the target tilt angle with the manually set angle of the blade. The controller may also receive a first correction parameter representative of a propulsion angle of the blade and/or a second correction parameter representative of a tilt angle of the vehicular body for correcting the target blade tilt angle based thereon during operation in response to the first operation command input under the first mode of the mode selection signal.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

Figure 3:
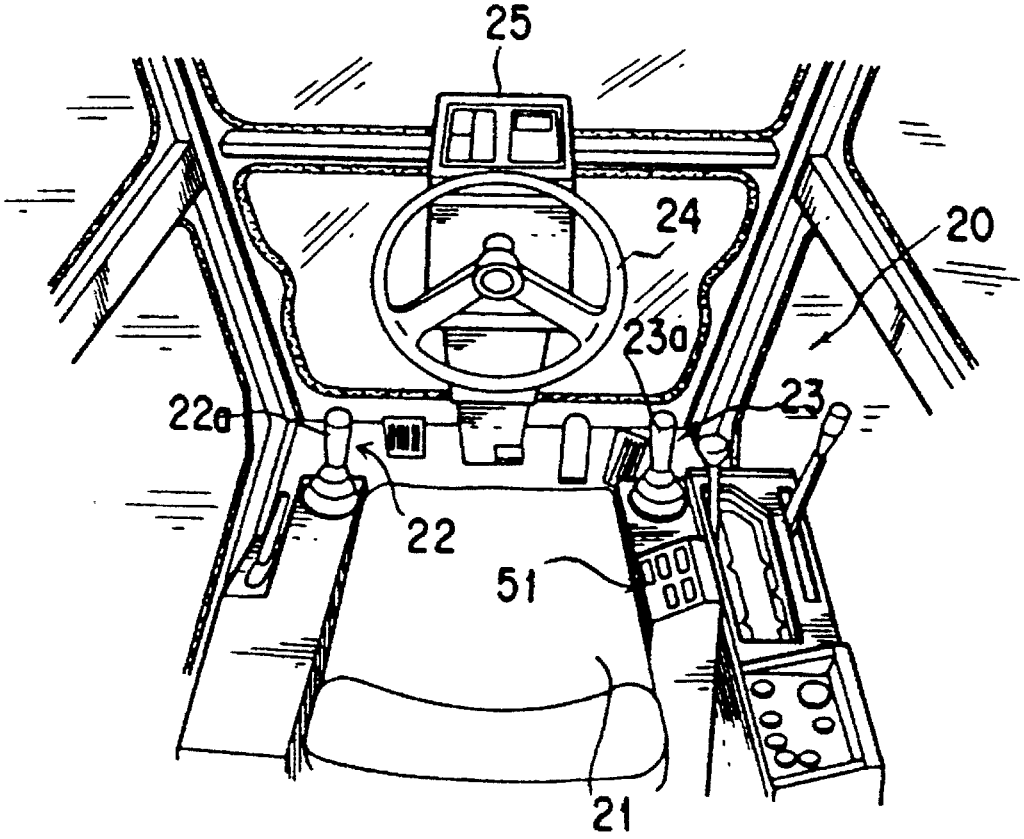
FIG. 3 is a perspective view of an operator cabin of the preferred embodiment of a motor grader according to the present invention.

Referring now to FIG. 3, there is illustrated the preferred embodiment of an operator's cabin or a cockpit 20 of a motor grader, according to the present invention. At both sides of a driver seat 21, a left operation lever assembly 22 and a right operation lever assembly 23 are arranged. The left and right operation lever assemblies 22 and 23 include operation levers 22*a* and 23*a* which can be manually operated by an operator. Also, a steering wheel 24 is positioned in front of the operator seat 21. The steering wheel 24 is supported on a supporting column 25.

The left and right operation lever assemblies 22 and 23 include electric signal generators, such as potentiometers for generating electric signals according to operation of the left and right operation levers 22*a* and 23*a*. The left and right operation levers 22*a* and 23*a* are designed to be operated in back and forth direction, a left and right direction, and in oblique directions, i.e. directions intermediate between the back and forth direction and left and right direction. Electric signals are generated in response to operation of the operation levers 22*a* and 23*a* representative of the operating direction of the operation levers. The magnitude of the electric signals is variable in proportion to the operation stroke of the operation lever. The electric signal generator, such as the potentiometer (not shown), is coupled with each operation lever 22*a* and 23*a* to generate the electric signal indicative of the operating direction and having the magnitude proportional to the operation stroke. The electric signals generated in response to the operation of the operation levers 22*a* and 23*a* will be hereafter referred to as "operation command signals".

Figure 4:
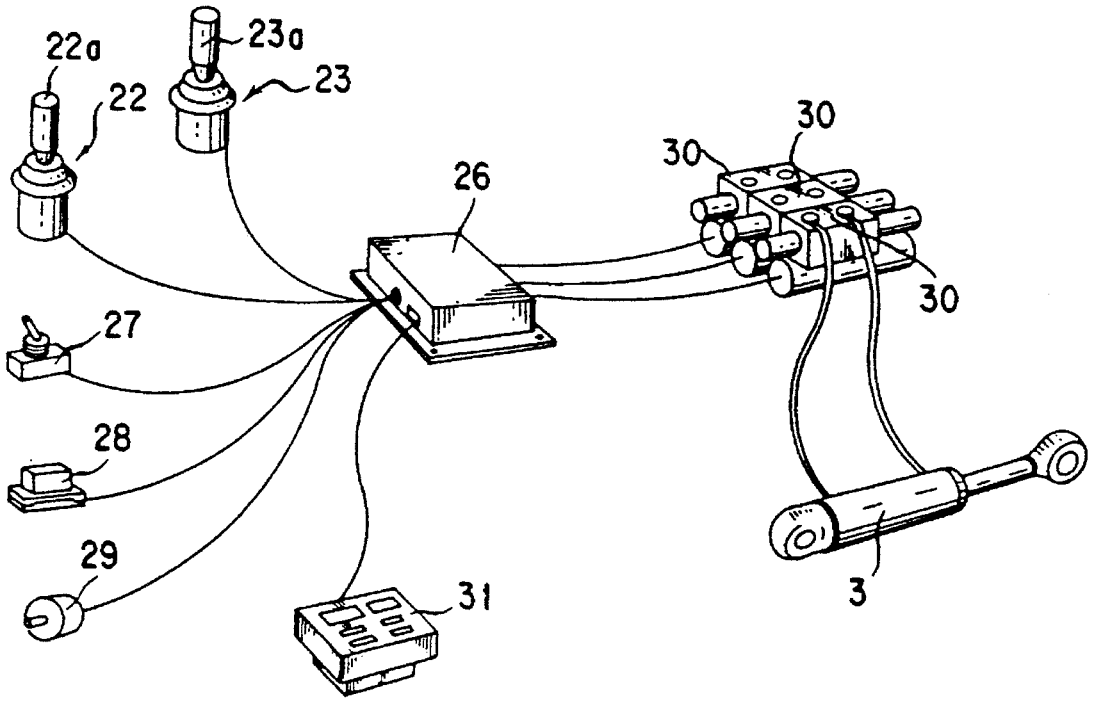
FIG. 4 is an exploded and diagrammatic illustration showing components forming the preferred embodiment of an operation system for the motor grader according to the present invention.

The operation lever assemblies 22 and 23 are connected to a microcomputer based controller 26 for inputting the operation command signals thereto, as shown in FIG. 4. The controller 26 is also connected to an ON/OFF switch or mode selector switch 27 for generating an ON/OFF signal, a tilt sensor 28 for generating a vehicle body tilt angle indicative signal, and a rotation sensor 29 for generating a swing circle angular position indicative signal. The controller 26 receives the ON/OFF signal of the ON/OFF switch 27, the vehicle body tilt angle indicative signal of the tilt sensor 28 and the swing circle angular position indicative signal of the rotation sensor 29 in addition to the operation command signals of the operation levers 22*a* and 23*a*. The controller 26 processes these inputs to generate electric signals for controlling direction control valves, such as electromagnetic proportioning valves 30, for supplying hydraulic pressure to a hydraulic swing motor and various cylinders. The electric signals controlling the direction control valves will be hereafter referred to as "operation control signals". Also, the controller 26 outputs an electric signal to a display panel 31 for displaying the operating condition and so forth. The signal to be fed to the display panel will be referred to hereafter as a "display signal".

Figure 5:
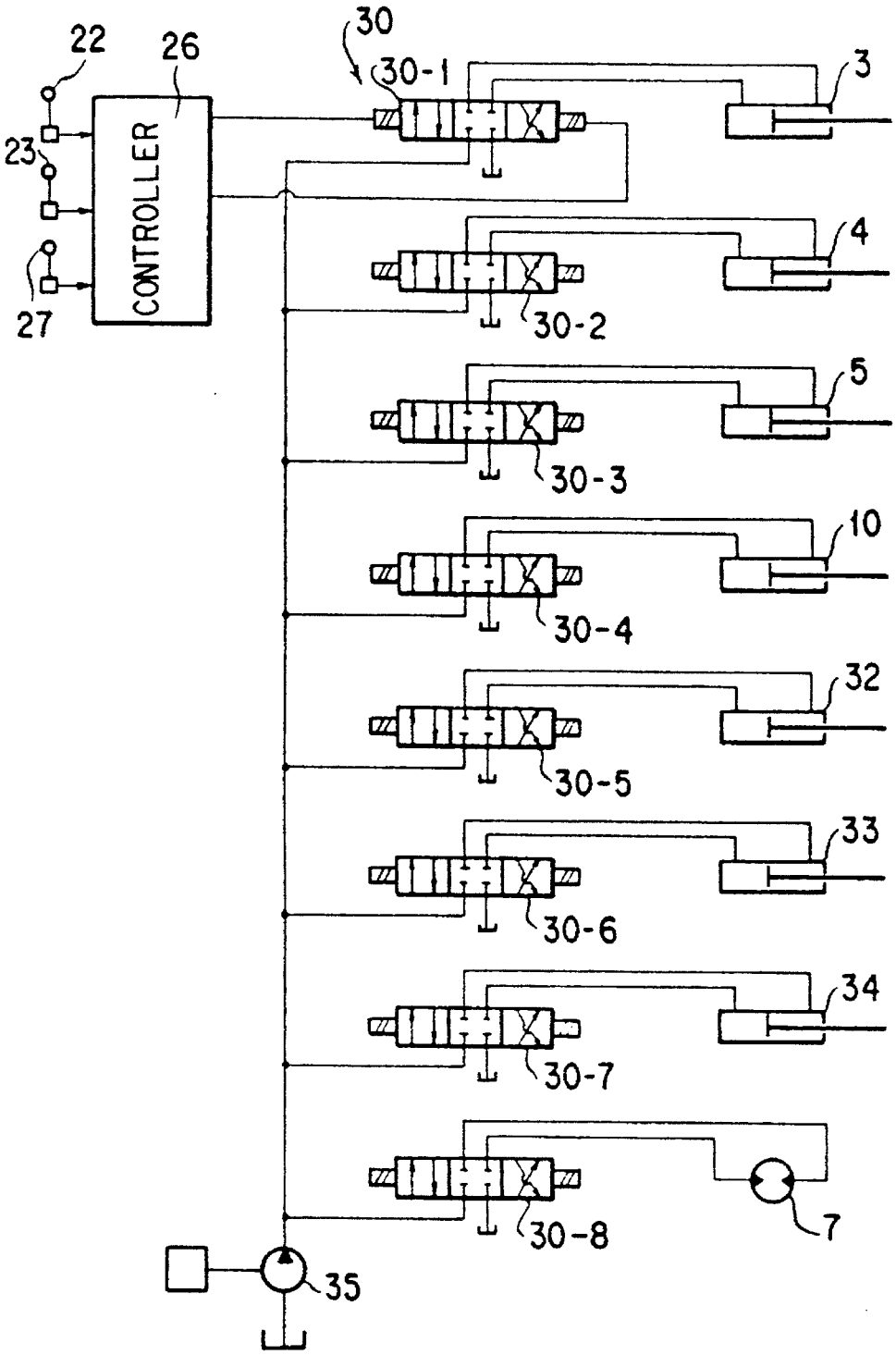
FIG. 5 is a diagram of a hydraulic circuit of the preferred embodiment of the motor grader of the invention.

FIG. 5 shows a hydraulic circuit to be employed in the preferred embodiment of the motor grader according to the present invention. A first electromagnetic proportioning valve 30-1 is communicated with the left lifting cylinder 3 for supplying the hydraulic pressure thereto. A second electromagnetic proportioning valve 30-2 is communicated with the right lifting cylinder 4 to supply thereto the hydraulic pressure. Similarly, a third electromagnetic proportioning valve 30-3 is connected to a lateral feed cylinder 5 to supply thereto the hydraulic pressure. A fourth electromagnetic proportioning valve 30-4 is connected to a shift cylinder 10 for supplying the hydraulic pressure to the latter. A fifth electromagnetic proportioning valve 30-5 is connected to the steering cylinder 32 for arcuating the vehicle body 1 in order to bend the vehicle body at the front and rear portions. A sixth electromagnetic proportioning valve 30-6 is connected to the cylinder to supply the hydraulic pressure thereto. A seventh electromagnetic proportioning valve 30-7 is connected to a scarifier cylinder 34. An eighth electromagnetic proportioning valve 30-8 is connected to the hydraulic swing motor 7 to supply thereto the hydraulic pressure. These first to eighth electromagnetic proportioning valves 30-1~30-8 are controlled as to the valve positions by the operation control signals from the controller 26. The first to eighth electromagnetic proportioning valves 30-1~30-8 are connected to a hydraulic pump 35 as a hydraulic pressure source and are designed to be operated to vary the fluid path areas depending upon the magnitudes of the operation control signals so that the fluid path areas are proportional to the magnitude of the operation control signals.

Figure 6:
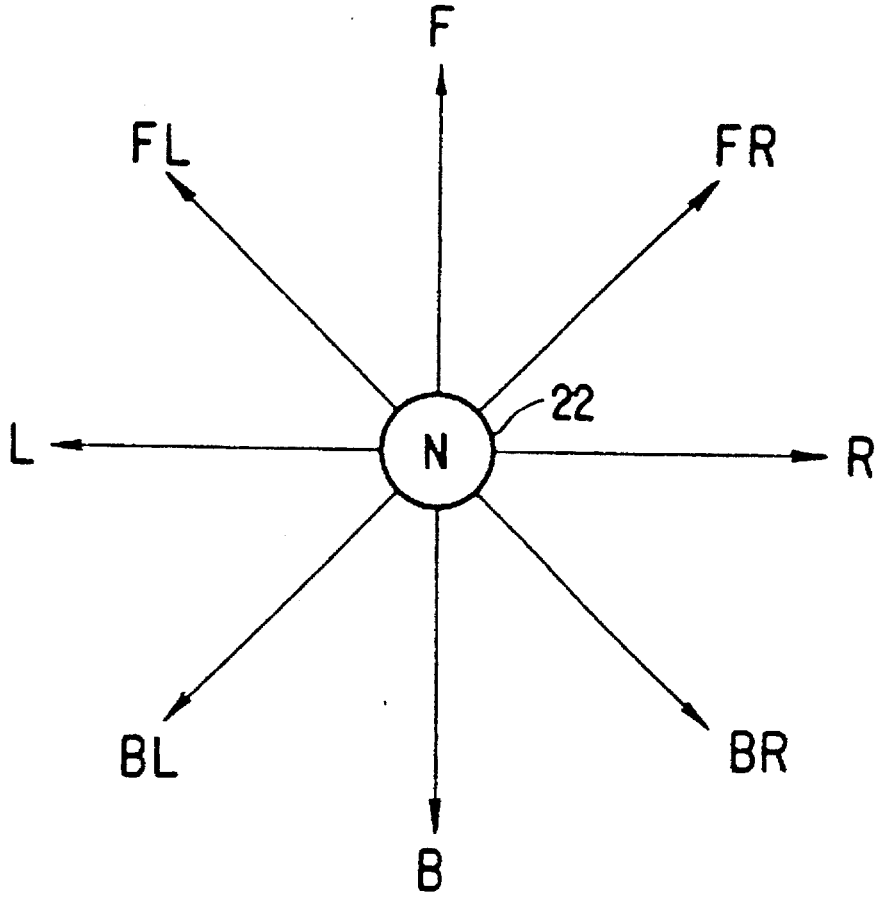
FIG. 6 is an illustration showing operating directions of a left operation lever in the preferred embodiment of the motor grader.
Figure 7:
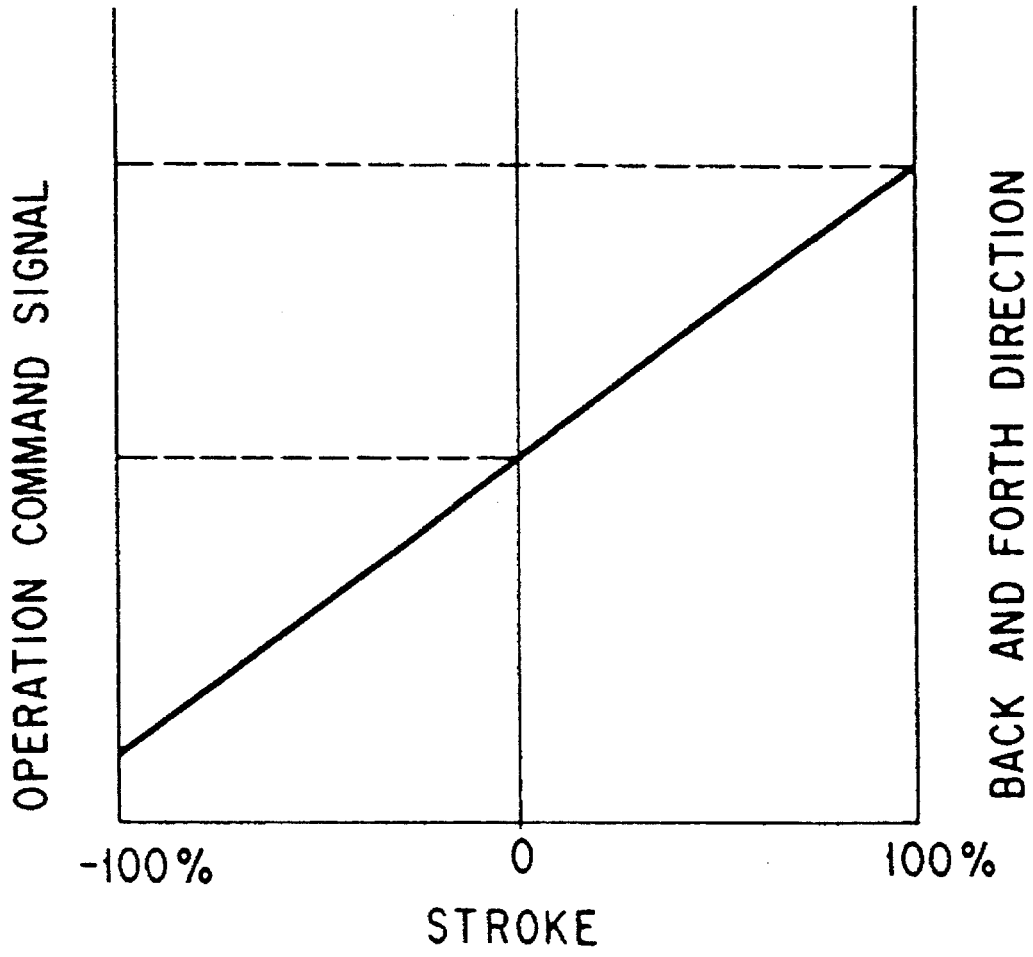
FIG. 7 is a chart showing a relationship between a magnitude of an operation command signal output from a left operation lever assembly and an operation stroke of a left operation lever.
Figure 8A:
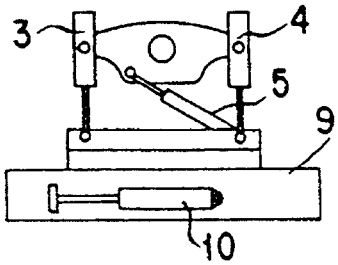
FIGS. 8(*a*)~8(*f*) are fragmentary illustrations of various attitudes of a blade to be situated by the preferred embodiment of the motor grader.
Figure 8B:
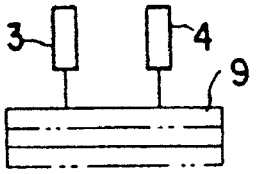
Figure 8C:
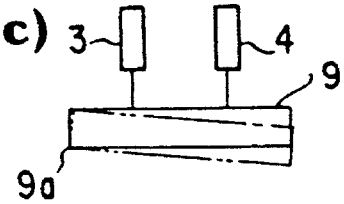
Figure 8D:
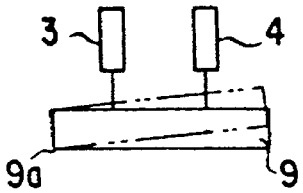
Figure 8E:
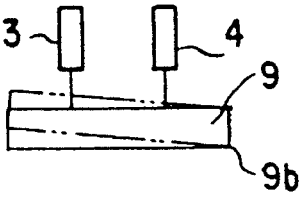
Figure 8F:
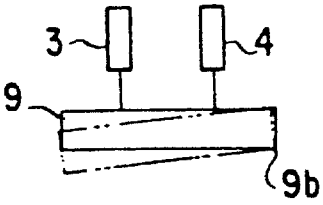

As shown in FIG. 6, the left operation lever 22*a* is operated in the directions of backward (B), forward (F), leftward (L), rightward (R), forward right (FR), forward left (FL), backward right (BR) and backward left (BL) directions. At each operating directions illustrated in FIG. 6, the magnitude of the operation command signal is variable in proportion to the stroke of the operation lever 22*a*, as shown in FIG. 7. The example of FIG. 7 shows a relationship between the back and forth stroke and the operation command signal, in which the operation command signal becomes a maximum value at the full stroke position of the operation lever 22*a* in the forward direction and a minimum at the full stroke position in the backward direction. The operation command signal generated by the left operation lever assembly 22 is input to the controller 26. The controller 26 discriminates an operation pattern on the basis of the ON/OFF signal from the ON/OFF switch 27 for selecting a combination of the operation control signals.

For instance, at the OFF position of the ON/OFF switch 27, the controller 26 outputs the operation control signals of one of the combination shown in the following table 1.

TABLE 1

| | Operation Pattern | | Operation Control Signals | | |
|---|---|---|---|---|---|
| | *1 | Operation | 30-1 | 30-2 | 30-3 |
| ON/ | N | Blade Stop | 0 | 0 | 0 |
| OFF | F | Blade Down | −1 | −1 | −β or −1/β |
| Switch | FR | Blade Right Down | −½ or −α | −1 | −β |
| OFF | R | Blade Stop | 0 | 0 | 0 |
| | BR | Blade Right Up | +½ or a | +1 | +β |
| | B | Blade Up | +1 | +1 | +β |
| | BL | Blade Left Up | +1 | +½ or +α | 0 |
| | L | Blade Stop | 0 | 0 | 0 |
| | FL | Blade Left Down | −1 | −½ or −α | 0 |

Note: *1: Operating Direction
α, β: Correction Coefficient

In the foregoing table 1, when the sign of the operation control signal is positive (+), the electromagnetic proportioning valves are switched to contract the corresponding cylinders, and when the sign of the operation control signals are negative (−), the electromagnetic proportioning valves are switched to expand the corresponding cylinders. With either sign, the value of the operation control signal is sequentially variable between 0to 1. Therefore, the indications +1 and −1 should be understood to indicate that the value of the operation control signal is within a range of 0 to +1 or −1 for adjusting the fluid flow path area in the electromagnetic proportioning valve.

Next, a discussion will be given for the operation of the blade in the operation patterns shown in the foregoing table 1. As shown in FIG. 8(*a*), when the left and right lifting cylinders 3 and 4 are expanded, the blade 9 is moved down. Conversely, by contracting the cylinders 3 and 4, the blade 9 is moved up. When the lateral feed cylinder 5 is expanded, the blade 9 is shifted toward the right. On the other hand, contraction of the lateral feed cylinder 5 causes shifting of the blade 9 toward the left. The shift cylinder 10 causes shifting of the blade 9 toward the left by expansion and toward the right by contraction.

When the blade 9 is to be moved down or lowered, the left and right lift cylinders 3 and 4 are simultaneously expanded. At the same time, the lateral feed cylinder 5 is expanded so that the blade 9 may be lowered on exactly the same vertical plane, as shown in FIG. 8(*b*). Namely, if the length of the lateral feed cylinder 5 is held constant, the downward movement of the blade 9 may cause a horizontal shift of the blade 9. In contrast, by adjusting the length of the lateral feed cylinder 5, the blade 9 can be moved down without causing shifting in the horizontal direction.

When the right side of the blade 9 is to be lowered, the left lift cylinder 3 is expanded in a given stroke, and the right lift cylinder 4 is also expanded in a stroke approximately double the given stroke of the left lift cylinder. In conjunction therewith, the lateral feed cylinder 5 is expended so that the blade 9 can be situated in the right side lowered position as shown in FIG. 8(*c*) without causing a variation of the position at the lower left side end 9*a*. Namely, by adjusting the length of the lateral feed cylinder 5, the blade 9 can be tilted with respect to the horizontal plane without causing shifting of the lower left side end of the blade 9.

On the other hand, when lifting up the right side of the blade 9, the left lift cylinder 3 is contracted for a given stroke, and the right lift cylinder 4 is contracted in a stroke approximately double the contraction stroke of the left lift cylinder 3. At the same time, the lateral feed cylinder 5 is also contracted to situate the blade at the right side risen position without causing a shifting of the lower left side end 9*a* as shown in FIG. 8(*d*).

When the left side is raised the left lift cylinder 3 is contracted in a given stroke and the right lift cylinder 4 is also lifted for a stroke approximately half the contraction stroke of the left lift cylinder 3. Then, the blade 9 can be situated at the left side raised position as shown in FIG 8(*e*). At this time, the position of the lower right side end 9*b* can be held in place.

When the left side is lowered, the left lift cylinder 3 is expanded for a given stroke and the right lift cylinder 4 is expanded for a stroke approximately half of the expansion stroke of the left lift cylinder 3.

On the other hand, when the ON/OFF switch 27 is held ON, the operation will take place in response to the operation of the operation lever 22*a* as shown in the following table 2.

TABLE 2

| | Operation Pattern | | Operation Control Signals | |
|---|---|---|---|---|
| | *1 | Operation | 30-4 | 30-8 |
| ON/OFF Switch ON | N | Blade Stop | 0 | 0 |
| | F | Blade Turn Left | +1 | 0 |
| | FR | Blade Turn Left While Maintaining Right End Constant | +1 | $+K_1$ (θ) |
| | R | Blade Shift Right | 0 | +1 |
| | BR | Blade Turn Right While Maintaining Right End Constant | −1 | $+K_2$ (θ) |
| | B | Blade Turn Right | −1 | 0 |
| | BL | Blade Turn Right While Maintaining Left End Constant | −1 | $+K_2$ (θ) |
| | L | Blade Shift Left | 0 | −1 |
| | FL | Blade Turn Left While Maintaining Left End Constant | +1 | $-K_1$ (θ) |

The operation of the blade 9 in the case of the foregoing table 2 will be discussed.

Figure 9A:
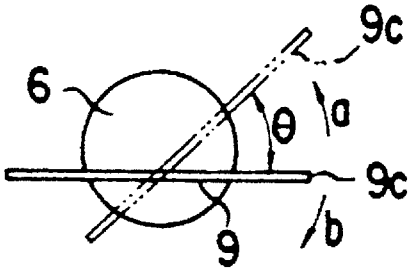
FIGS. 9(*a*)~9(*c*) are illustrations showing a manner of swing motion of the blade in the preferred embodiment of the motor grader.
Figure 9B:
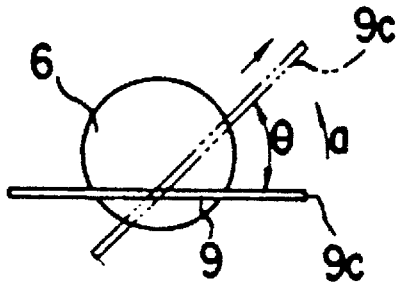
Figure 9C:
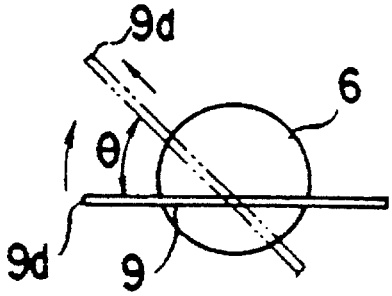

When the blade 9 is turned or pivoted toward the left, the hydraulic swing motor 7 is driven to turn the blade 9 together with the swing circle 6 as shown by the arrow a of FIG. 9(*a*).

When the blade 9 is to be turned toward the left while maintaining the right end of the blade at the constant position, in conjunction with driving of the hydraulic swing motor 7 for driving the swing circle 6 to turn toward the left, the shift cylinder 10 is contracted to shift the blade 9 toward the right relative to the swing circle 6. By this, the right end 9*c* of the blade 9 can be maintained at the constant position as shown in FIG. 9(*b*).

Namely, when the blade 9 is turned toward the left as shown in FIG. 9(*a*), the right end 9*c* of the blade 9 is displaced toward the left depending upon the turning angle 8, i.e. $K_1$, $K_2$ and the length of the blade. In practice, since the length of the blade 9 is known, the magnitude of a leftward shifting of the blade 9 can be arithmetically derived on the basis of the swing or pivoting angle 8 detected by the rotation sensor 29. Therefore, the stroke of the shifting cylinder 10 can be derived for compensating the arithmetically calculated leftward shift of the blade 9. By compensating such displacement by contraction of the shift cylinder 10, the right end 9*c* of the blade 9 can be held at the constant position.

When the blade 9 is to be shifted toward the right, the shift cylinder 10 is contracted to shift the blade toward the right.

When the blade 9 is to be turned to the right while maintaining the right end 9*c* at the constant position, the hydraulic motor 7 is driven in the direction opposite to the for a left turn. In conjunction therewith, the shift cylinder 10 is contracted to shift the blade 9. By this, the right end 9*c* of the blade 9 can be held at the constant position.

When the blade 9 is to be turned toward the right, the hydraulic swing motor 7 is driven in the opposite direction to that for a left turn, to turn the blade 9 in the direction of the arrow b of FIG. 9(*a*).

When the blade is to be turned toward the right while maintaining the left end 9*d* at the constant position, the shift cylinder 10 is expanded to shift the blade 9 toward the left in conjunction with turning the blade 9 toward the right by the hydraulic swing motor 7, as shown in FIG. 9(*c*). By this operation, the left end 9*d* of the blade 9 can be maintained at the constant position while the blade 9 is turned toward the right.

When the blade 9 is to be shifted toward the left, the shift cylinder 10 is expended to cause shifting of the blade 9 toward the left.

When the blade is to be turned to the left while maintaining the left end 9*d* at the constant position, the shift cylinder 10 is expanded to shift the blade 9 toward the left in conjunction with driving of the hydraulic swing motor 7 to turn the blade 9 toward the left. By this, left turn of the blade 9 while maintaining the left end 9*d* at the constant position can be achieved.

Figure 10:
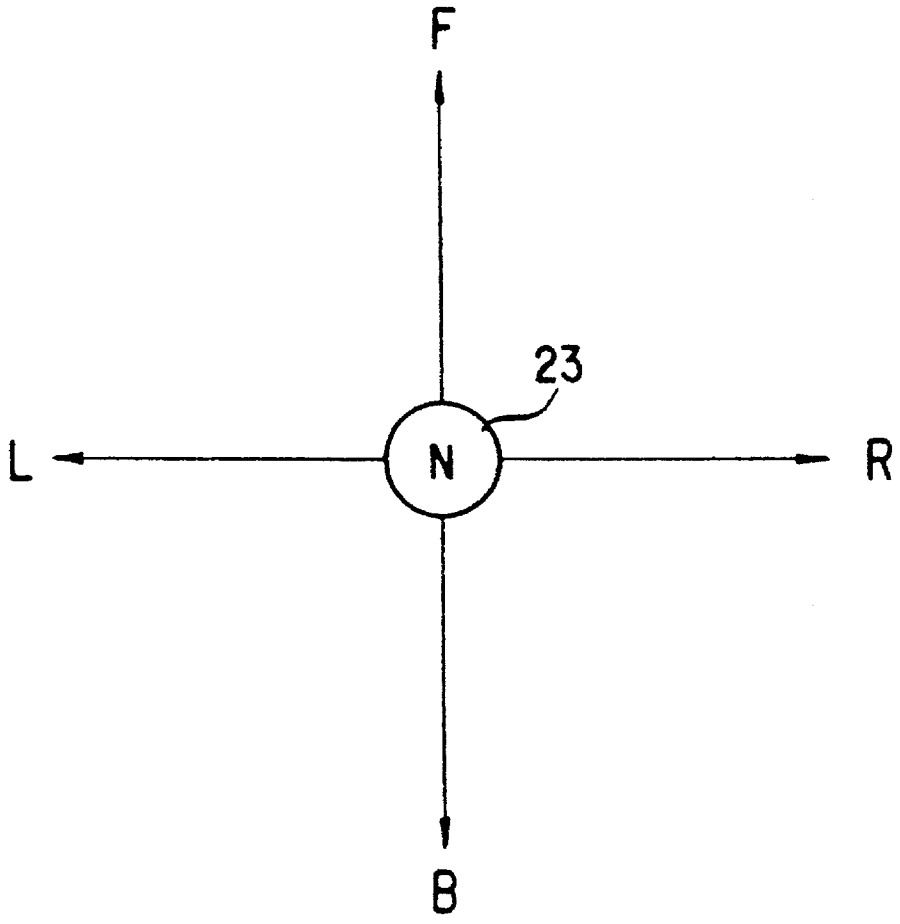
FIG. 10 is an illustration showing operating directions of a right operation lever according to the invention.
Figure 11:
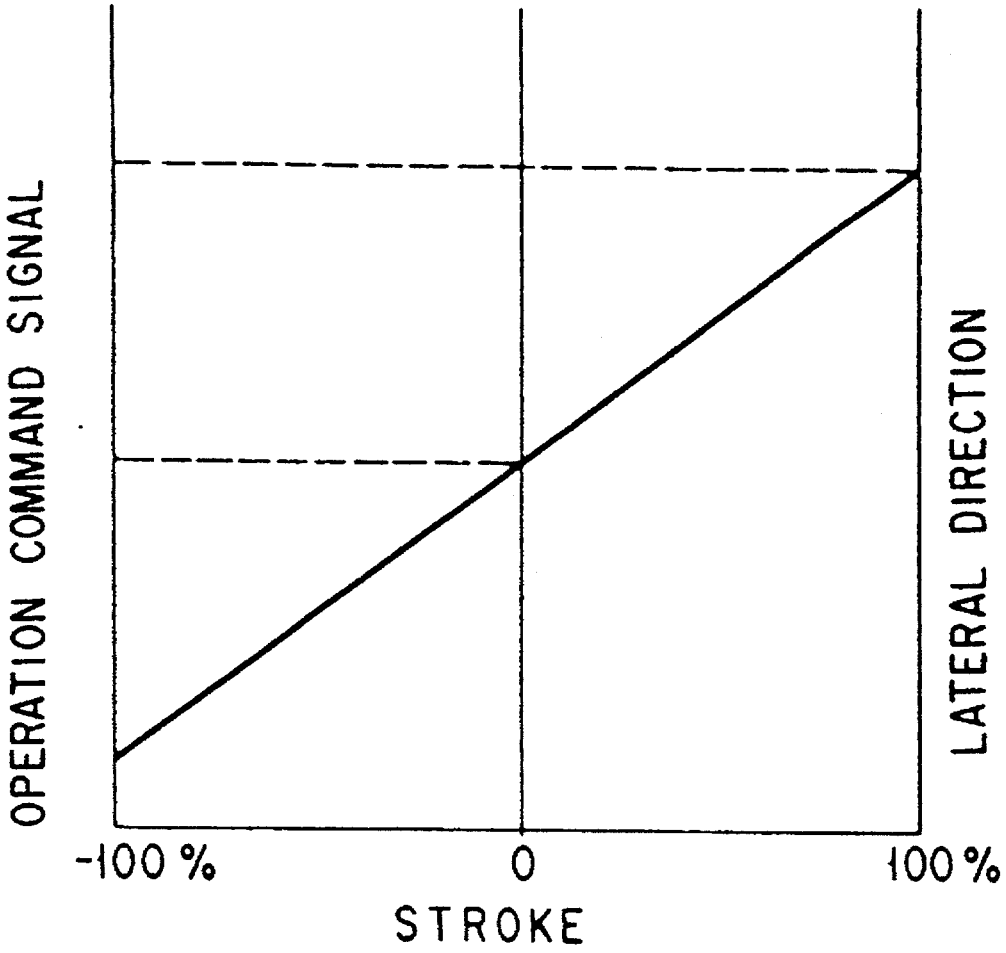
FIG. 11 is a chart showing a relationship between a magnitude of an operation command signal output from a right operation lever assembly and an operation stroke of a right operation lever.

In the shown embodiment, the right operation lever 23*a* of the right operation lever assembly 23 is operable in the forward (F), backward (B), leftward (L) and rightward (R) directions, as shown in FIG. 10. At each operating direction, the operation command signal varies the magnitude thereof proportional to the operation stroke of the operation lever 23*a*, as shown in FIG. 41. Similarly to the operation through the operation lever 22*a*, the operation command signals of the operation lever assembly 23 are input to the controller 26. The controller 26 discriminates the operation pattern on the basis of the input operation command signal and the ON/OFF signal of the ON/OFF switch The operation patterns to be commanded by the operation command signals while the ON/OFF switch 27 is held OFF are shown in the following table 3.

TABLE 3

| | Operation Pattern | | Operation Control Signals | |
|---|---|---|---|---|
| | *1 | Operation | 30-3 | 30-7 |
| ON/OFF Switch OFF | N | Stop | 0 | 0 |
| | F | Scarifier Down | 0 | +1 |
| | R | Draw Bar Shift Right | +1 | 0 |
| | B | Scarifier Up | −1 | 0 |
| | L | Draw Bar Shift Left | −1 | 0 |

Namely, when the right operation lever 23*a* is operated frontwardly, the scarifier cylinder 34 is operated to lower the scarifier. When the right operation lever 23*a* is operated toward the right, the lateral feed cylinder 5 is expanded to shift the draw bar toward the right. When the right operation lever 23*a* is operated backwardly, the scarifier cylinder 34 is contracted to lift up the scarifier. On the other hand, when the right operation lever 23*a* is operated toward the left, the lateral feed cylinder 5 is contracted to shift the draw bar toward the left.

The operation patterns to be commanded by the operation command signals while the ON/OFF switch 27 is held ON are shown in the following table 4.

TABLE 4

| | Operation Pattern | | Operation Control Signals | |
|---|---|---|---|---|
| | *1 | Operation | 30-3 | 30-7 |
| ON/OFF Switch ON | N | Stop | 0 | 0 |
| | F | Vehicle Body Arcuate toward Left | +1 | 0 |
| | R | Front Wheel Right Leaning | 0 | +1 |
| | B | Vehicle Body Arcuate toward Right | −1 | 0 |
| | L | Front Wheel Left Leaning | 0 | −1 |

Namely, when the right operation lever 23*a* is operated frontwardly, the steering cylinder 32 is expanded to arcuate the vehicle body toward the left. When the right operation lever 23*a* is operated toward the right, the leaning cylinder 33 is expanded to cause a rightward leaning of the front wheel. When the right operation lever 23*a* is operated backwardly, the steering cylinder 32 is contracted to arcuate the vehicle body toward the right. On the other hand, when the right operation lever 23*a* is operated toward the left, the leaning cylinder 33 is contracted to cause a leftward leaning of the front wheel.

Figure 12:
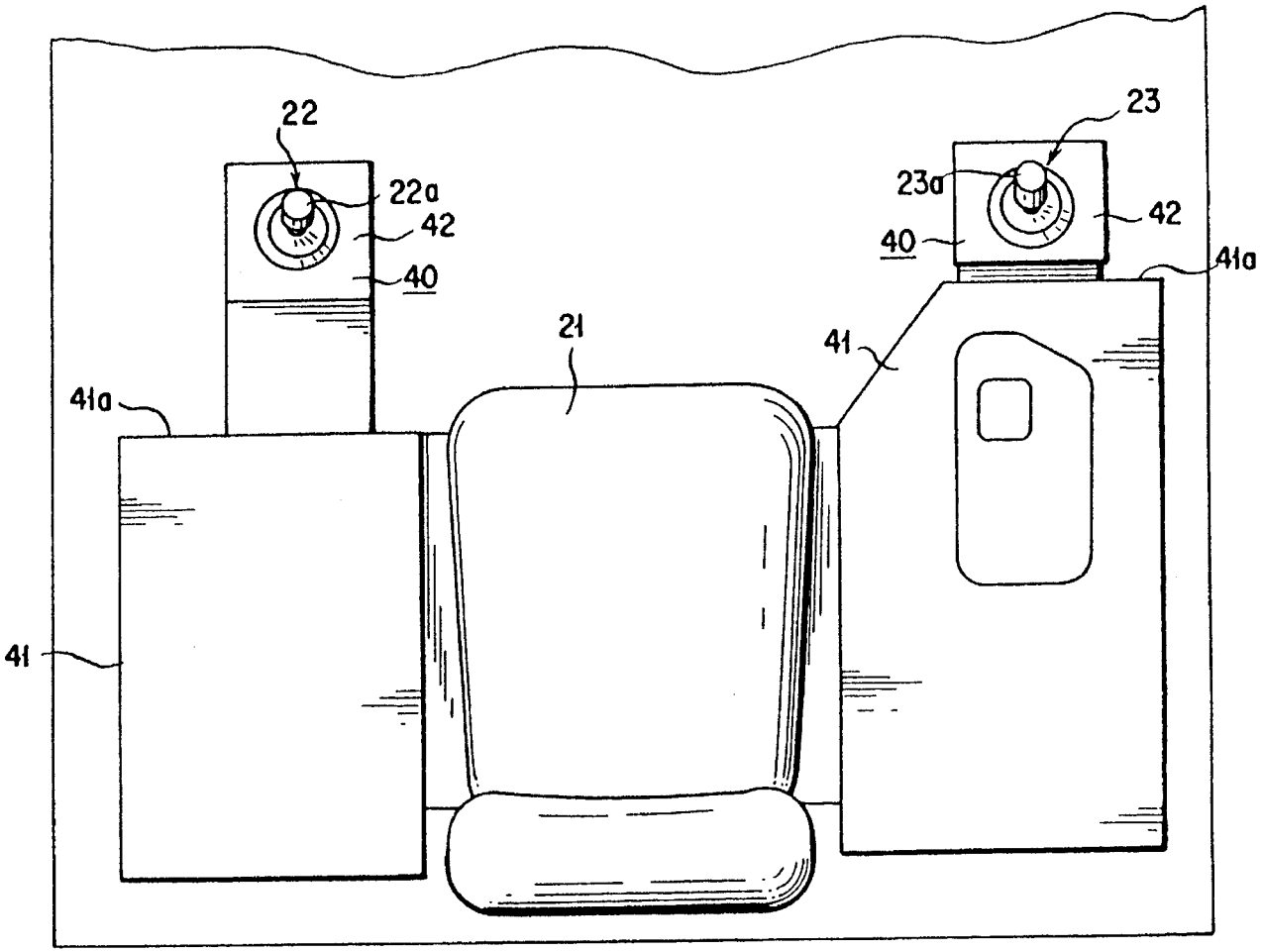
FIG. 12 is a plan view showing an alternative arrangement of the operation levers of the present invention.
Figure 13:
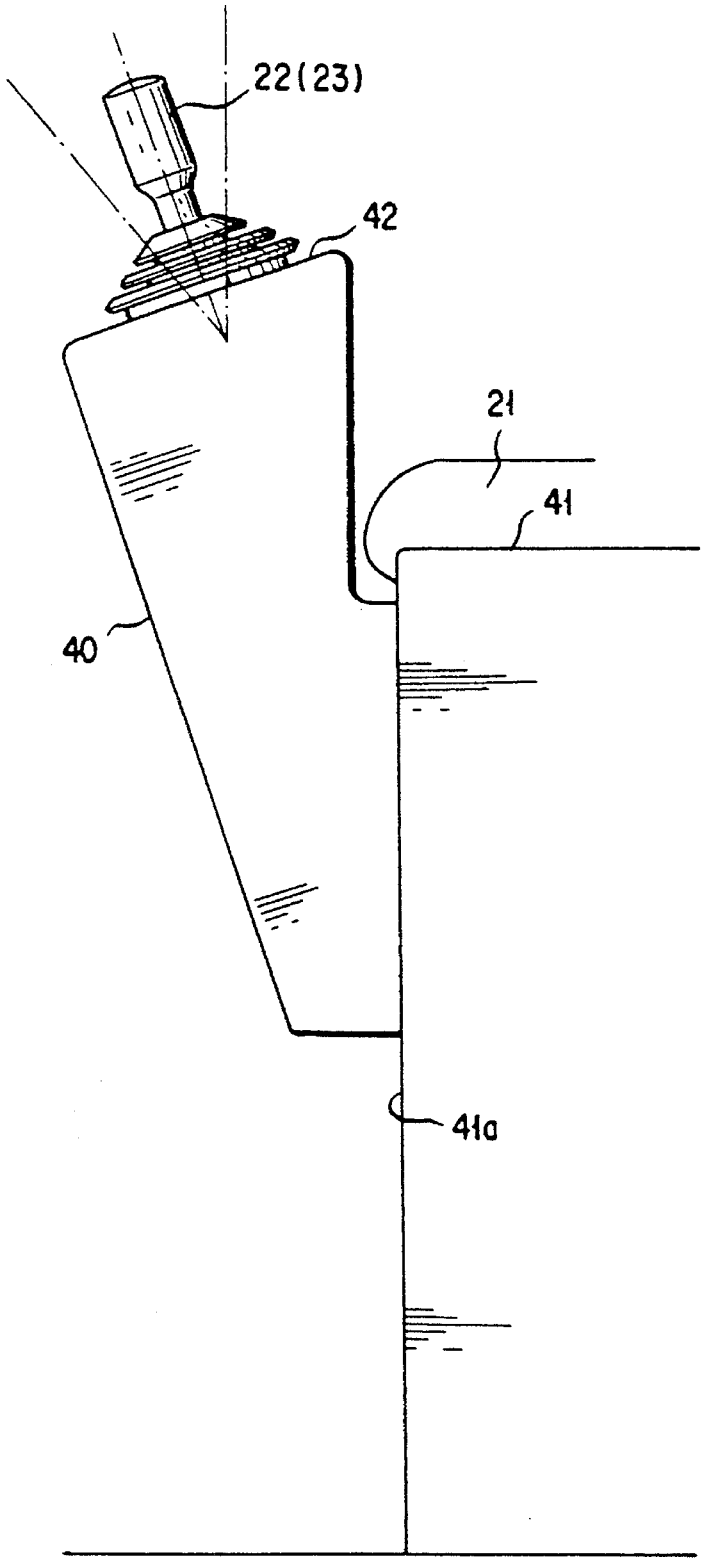
FIG. 13 is a side elevation of a portion where the operation lever is mounted.

As shown in FIGS. 12 and 13, the left and right operation lever assemblies 22 and 23 are mounted on housings 40 provided at both sides of the operator seat 21 Namely, at both sides of the operator seat 21, boxes 41 are mounted. The housings 40 are respectively mounted on the front end faces 41*a* of the boxes 41. The upper plates 42 of respective housings 40 are descending frontwardly, while the left and right operation levers 22 and 23 respectively substantially perpendicular to the upper surfaces 42 of the housings 40.

With this arrangement, the left and right operation levers 22*a* and 23*a* are slightly tilted toward the front at the neutral positions so that they may be placed at vertical position as operated backwardly. This facilitates manual operation of these levers by the operator seated on the operator seat 21.

Figure 14:
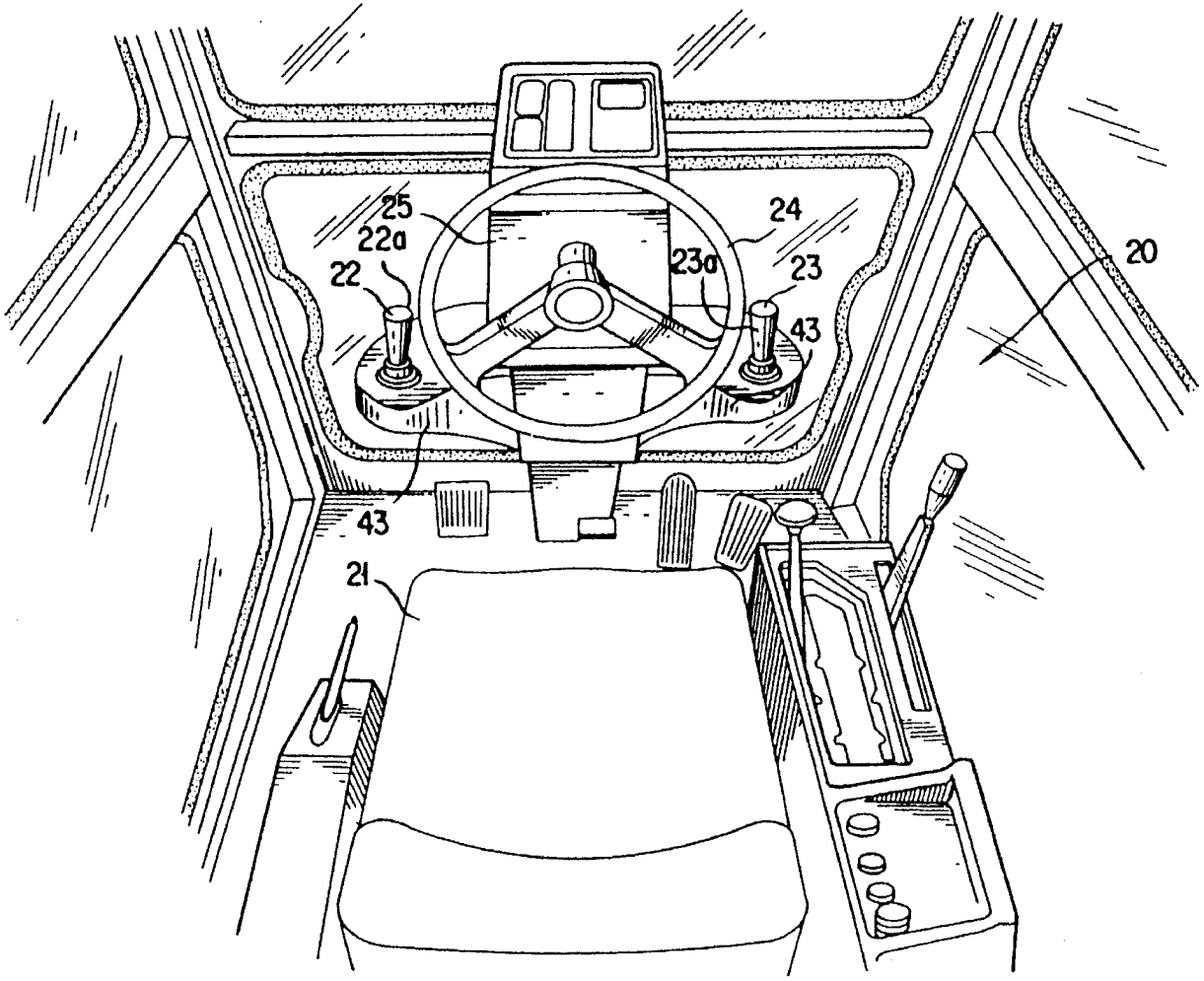
FIG. 14 is a perspective view of the operator's cabin employing a further alternative arrangement of operation levers.
Figure 15:
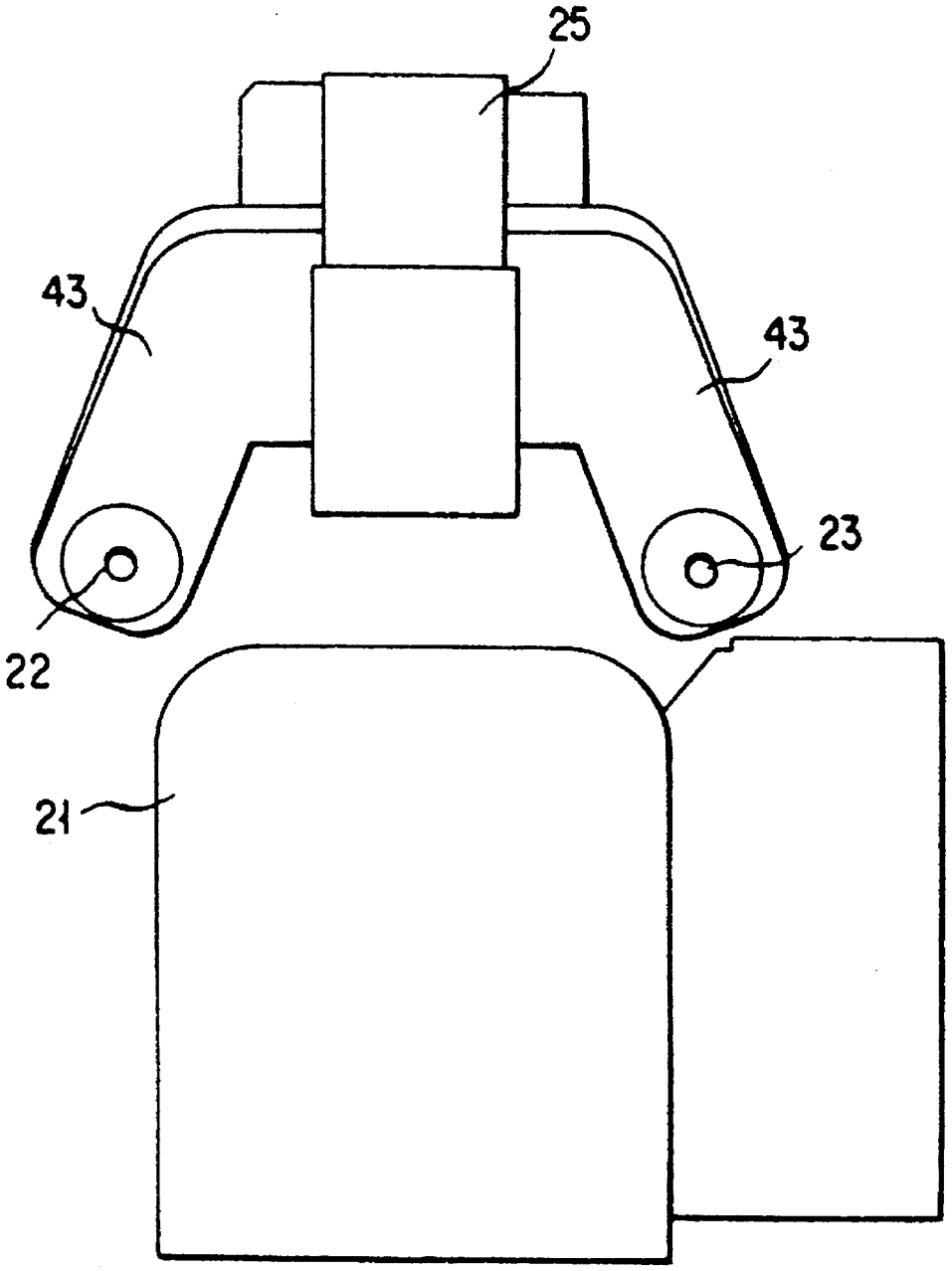
FIG. 15 is an enlarged plan view of the operation levers arranged in the manner illustrated in FIG. 14.

While the specific arrangement of the left and right operation lever assemblies 22 and 23 is illustrated and discussed hereabove, the arrangement of the operation lever assemblies 22 and 23 can be modified in various fashions. For instance, the operation lever assemblies 22 and 23 can be arranged as illustrated in FIGS. 14 and 15. In this case, housings 43 of the operation lever assemblies 22 and 23 are mounted on the supporting column 25 of the steering wheel 24. In this case, the operation levers 22*a* and 23*a* are extended from the upper surfaces of the housings 43.

Figure 16:
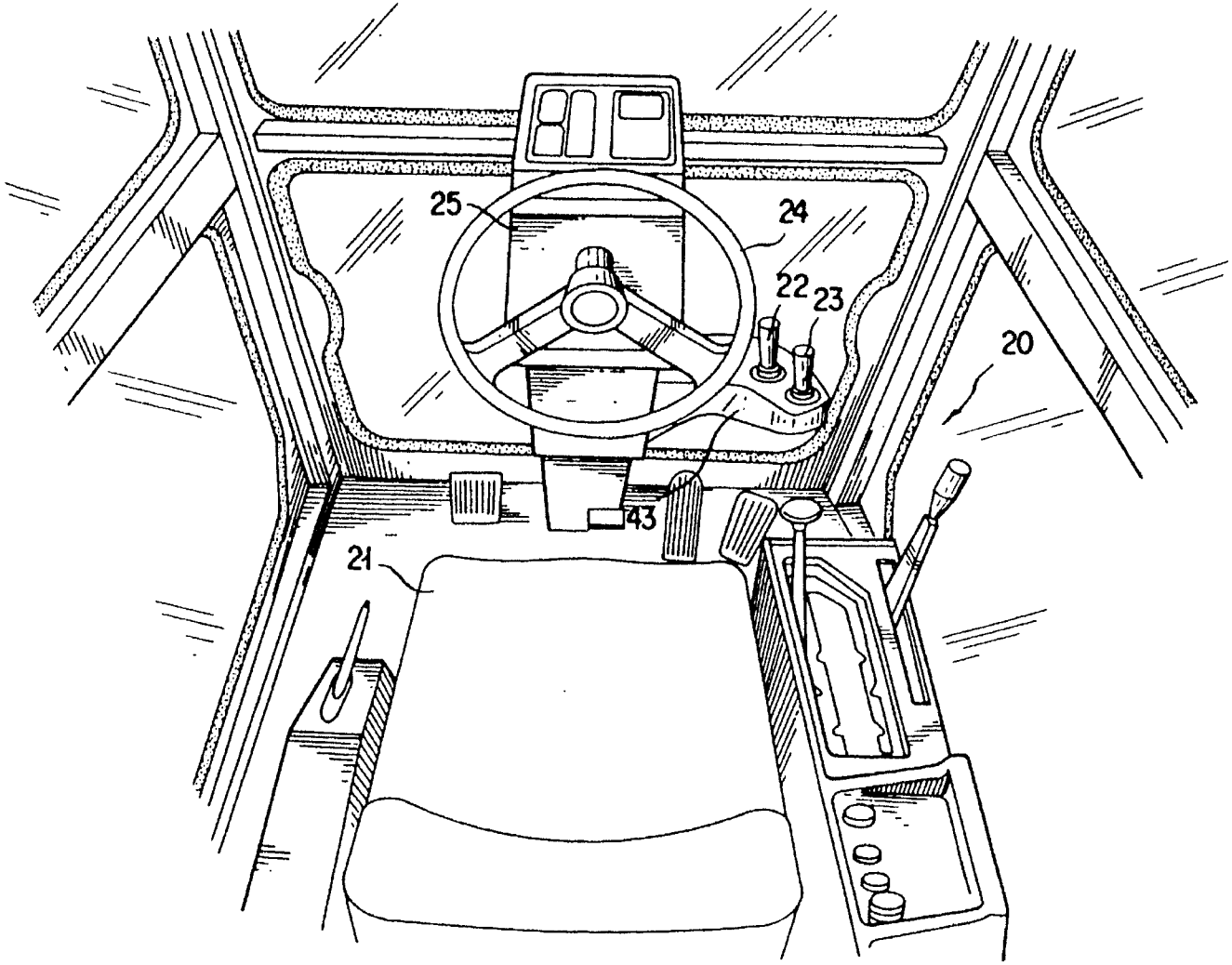
FIG. 16 is a perspective view of the operators cabin employing a still further alternative arrangement of operation levers.
Figure 17:
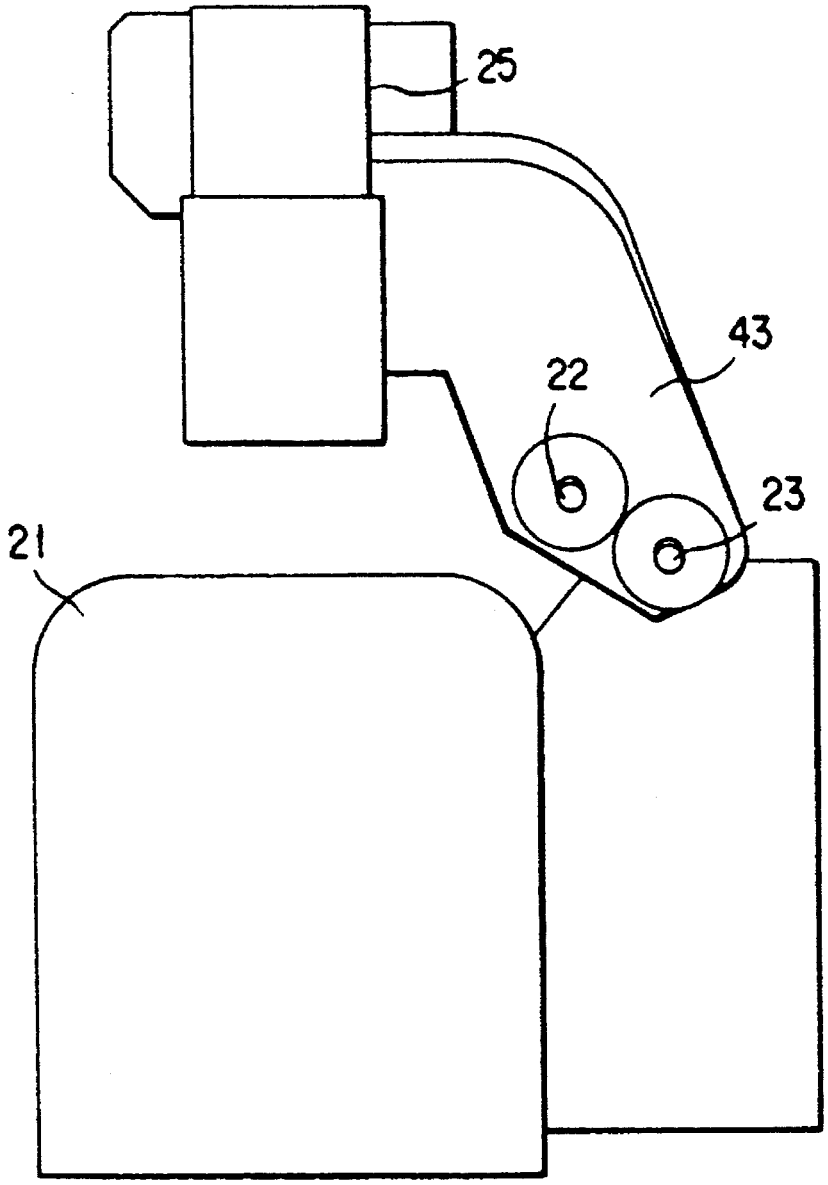
FIG. 17 is an enlarged plan view of the operation levers arranged in the manner illustrated in FIG. 16.
Figure 18:
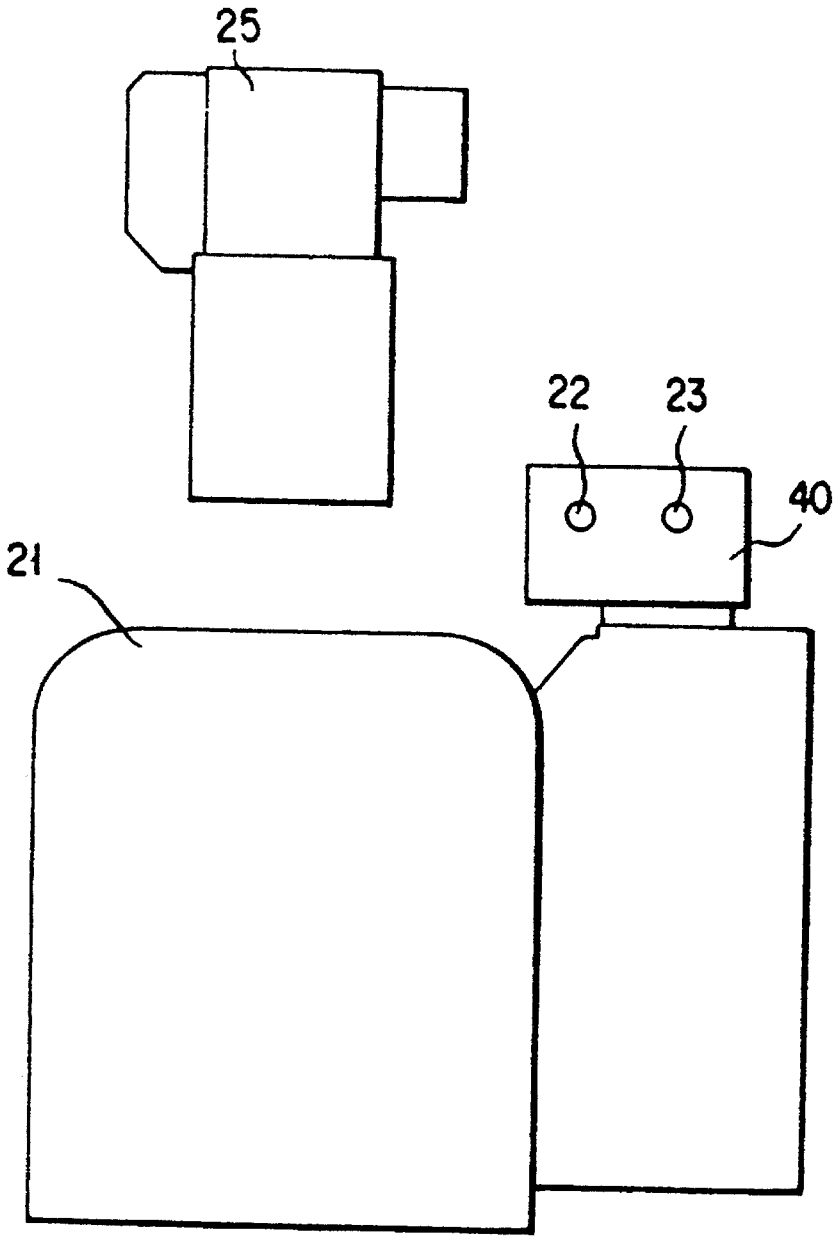
FIG. 18 is a plan view showing a yet further alternative arrangement of the operation levers.

Also, it is further possible to arrange both operation lever assemblies 22 and 23 on a common housing 43 at one side of the supporting column 25, as illustrated in FIGS. 16 and 17. Furthermore, as shown in FIG. 18, it is possible to arrange both operation lever assemblies 22 and 23 on the common housing 40 mounted on the operator seat 21.

As can be appreciated, the operating directions of the operation levers 22*a* and 23*a* and the associated operation patterns are not restricted to those set forth above and can be modified in various fashion. The following are examples of modifications of the operating directions of the operation levers 22*a* and 23*a* and the associated operation patterns.

When the left operation lever 22*a* is operated while the ON/OFF switch 27 is held OFF, the operation patterns illustrated in the following table 5 can be established:

TABLE 5

| | Operation Pattern | | Operation Control Signals | |
|---|---|---|---|---|
| | *1 | Operation | 30-4 | 30-8 |
| ON/OFF Switch OFF | N | Blade Stop | 0 | 0 |
| | F | Blade Turn Left | +1 | 0 |
| | FR | Blade Turn Left While Maintaining Right End Constant | +1 | $+K_1(\theta)$ |
| | R | Blade Shift Right | 0 | +1 |
| | BR | Blade Turn Right While Maintaining Right End Constant | −1 | $+K_2(\theta)$ |
| | B | Blade Turn Right | −1 | 0 |
| | BL | Blade Turn Right While Maintaining Left End Constant | −1 | $+K_2(\theta)$ |
| | L | Blade Shift Left | 0 | −1 |
| | FL | Blade Turn Left While Maintaining Left End Constant | +1 | $-K_1(\theta)$ |

When the left operation lever 22*a* is operated while on the ON/OFF switch 27 is held ON, the operation patterns illustrated in the following table 6 can be established:

TABLE 6

| | Operation Pattern | | Operation Control Signals | |
|---|---|---|---|---|
| | *1 | Operation | 30-3 | 30-7 |
| ON/OFF Switch ON | N | Stop | 0 | 0 |
| | F | Scarifier Down | 0 | +1 |
| | R | Draw Bar Shift Right | +1 | 0 |
| | B | Scarifier Up | −1 | 0 |
| | L | Draw Bar Shift Left | −1 | 0 |

When the right operation lever 23*a* is operated while on ON/OFF switch 27 is held OFF, the operation patterns illustrated in the following table 7 can be established:

TABLE 7

| | Operation Pattern | | Operation Control Signals | | |
|---|---|---|---|---|---|
| | *1 | Operation | 30-1 | 30-2 | 30-3 |
| ON/OFF Switch OFF | N | Blade Stop | 0 | 0 | 0 |
| | F | Blade Down | −1 | −1 | $-\beta$ or $-1/\beta$ |
| | FR | Blade Right Down | −½ or $-\alpha$ | −1 | $-\beta$ |
| | R | Blade Stop | 0 | 0 | 0 |
| | BR | Blade Right Up | +½ or $-\alpha$ | +1 | $+\beta$ |

TABLE 7-continued

| Operation Pattern | | Operation Control Signals | | |
|---|---|---|---|---|
| *1 | Operation | 30-1 | 30-2 | 30-3 |
| B | Blade Up | +1 | +1 | +β |
| BL | Blade Left Up | +1 | +½ or +α | 0 |
| L | Blade Stop | 0 | 0 | 0 |
| FL | Blade Left Down | −1 | −½ or α | 0 |

When the right operation lever 23*a* is operated while the ON/OFF switch 27 is held ON, the operation patterns illustrated in the following table 8 can be established:

TABLE 8

| | Operation Pattern | | Operation Control Signals | |
|---|---|---|---|---|
| | *1 | Operation | 30-5 | 30-6 |
| ON/OFF Switch ON | N | Stop | 0 | 0 |
| | F | Vehicle Body Arcuate toward Left | +1 | 0 |
| | R | Front Wheel Right Leaning | 0 | +1 |
| | B | Vehicle Body Arcuate toward Right | −1 | |
| | L | Front Wheel Left Leaning | 0 | −1 |

It should be noted that the practical operations according to the foregoing tables 5 to 8 are the same as those of the foregoing embodiment. With the shown arrangement, the turning of the blade can be controlled by the left operation lever 22*a* and the lifting up and down of the blade 9 can be controlled by the right operation lever 23*a*.

Also, it is possible to provide a function of steering for one of the operation lever assemblies 22 and 23. For instance, in the foregoing embodiment, it may be possible to provide functions of steering and vehicle drive direction switching for the left operation lever assembly 22 instead of functions for operating the scarifier, draw bar, arcuating of the vehicle body and leaning of the front wheel. Such embodiment is illustrated in FIGS. 19 and 20.

Figure 19:
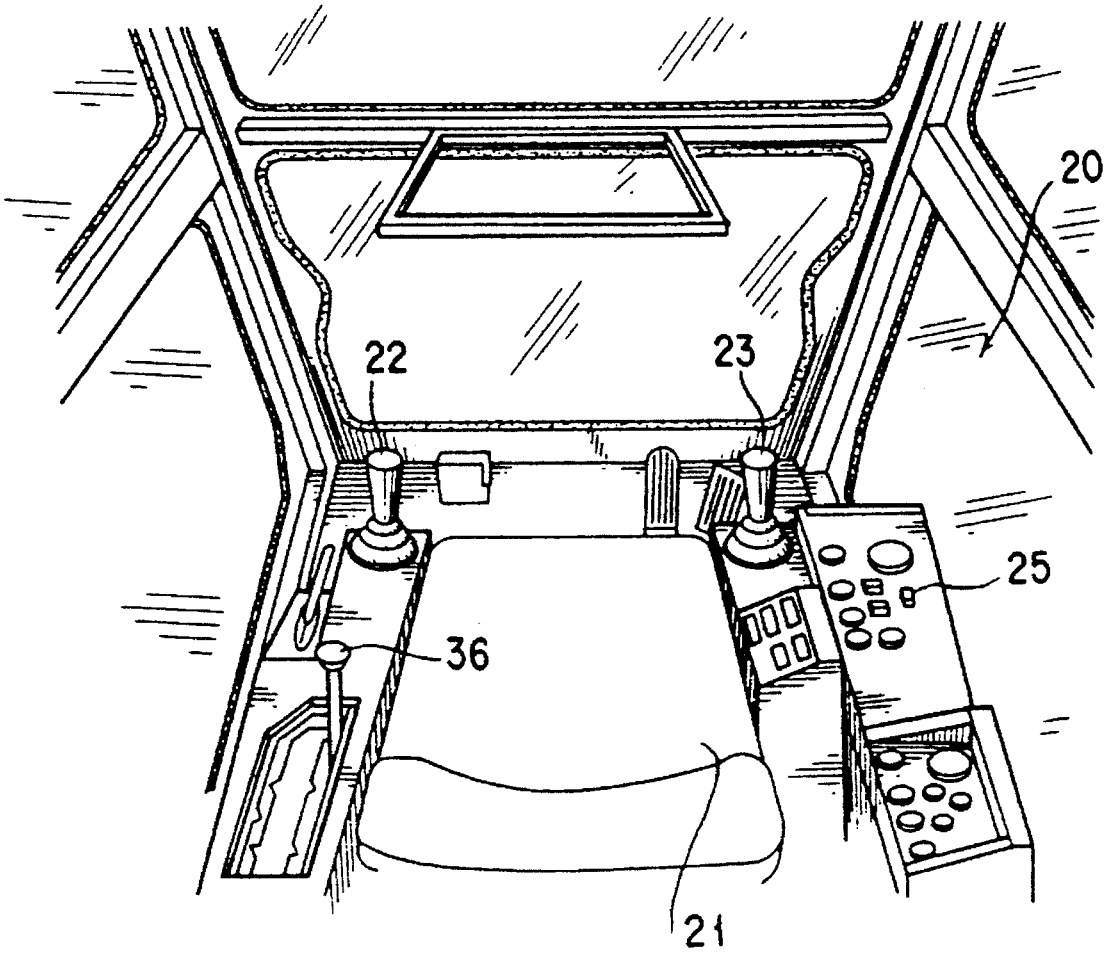
FIG. 19 is a perspective view of another embodiment of the motor grader according to the invention.
Figure 20:
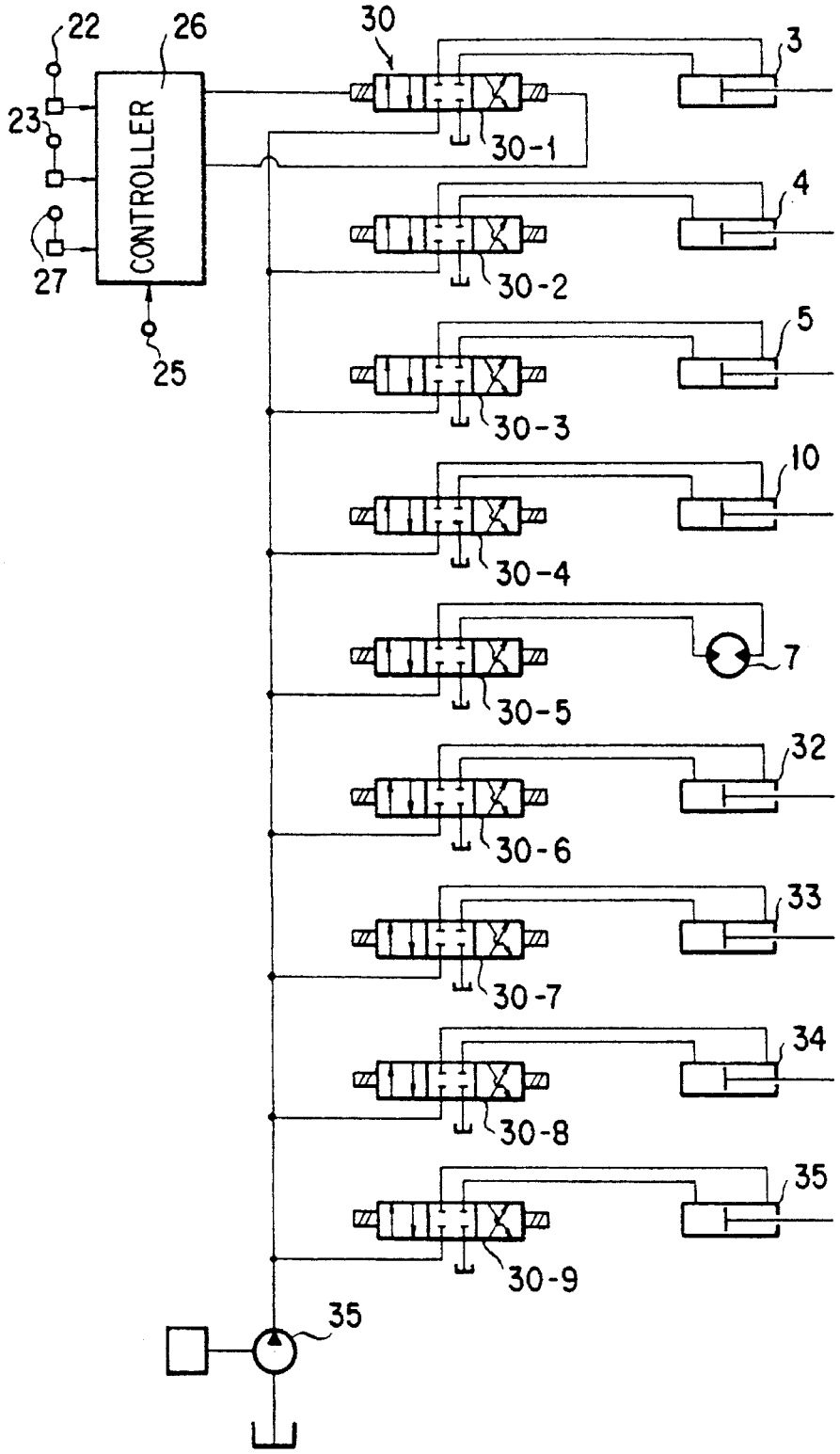
FIG. 20 is a diagram of a hydraulic circuit to be employed in the motor grader of FIG. 19.

As shown in FIG. 19, the shown embodiment eliminates the steering wheel since the steering operation can be performed by the left operation lever assembly 22. For enabling switching of the driving direction of the vehicle, a forward/reverse switching cylinder 35 is provided in the hydraulic circuit as shown in FIG. 20. The forward/reverse switching cylinder 34 is connected to a forward/reverse switching direction control valve 30–8.

In such case, the operation patterns at the OFF and ON states of the ON/OFF switch are shown in the following tables 9 and 10.

TABLE 9

| | Operation Pattern | | Operation Control Signals | | |
|---|---|---|---|---|---|
| | *1 | Operation | 30-6 | 30-7 | 30-8 |
| ON/OFF Switch OFF | N | Stop | 0 | 0 | 0 |
| | F | Forward | 0 | 0 | +1 |
| | FR | Forward and Turn Right | +1 | 0 | +1 |
| | R | — | — | — | — |
| | FL | Forward and Turn Left | −1 | 0 | +1 |
| | L | — | — | — | — |
| | B | Reverse | 0 | 0 | −1 |

TABLE 9-continued

| | Operation Pattern | | Operation Control Signals | | |
|---|---|---|---|---|---|
| | *1 | Operation | 30-6 | 30-7 | 30-8 |
| | BR | Reverse and Turn Right | +1 | 0 | −1 |
| | BL | Reverse and Turn Left | −1 | 0 | −1 |

TABLE 10

| | Operation Pattern | | Operation Control Signals | | |
|---|---|---|---|---|---|
| | *1 | Operation | 30-6 | 30-7 | 30-8 |
| ON/OFF Switch ON | N | Stop | 0 | 0 | 0 |
| | F | Forward | 0 | 0 | +1 |
| | FR | Forward and Turn Right | +1 | +1 | +1 |
| | R | — | — | — | — |
| | FL | Forward and Turn Left | −1 | −1 | +1 |
| | L | — | — | — | — |
| | B | Reverse | 0 | 0 | −1 |
| | BR | Reverse and Turn Right | +1 | −1 | −1 |
| | BL | Reverse and Turn Left | −1 | +1 | −1 |

As can be seen, either at an ON or an OFF position of the ON/OFF switch, the forward driving of the vehicle can be commanded by operating the operation lever 22 frontwardly. The forward/reverse switching cylinder 34 is then expanded to establish a power transmission path in a power transmission for forward driving of the vehicle. The transmission speed ratio in the forward driving position may be selected through a shift lever or selector lever 36 provided at the left side of the operator seat 21, as shown in FIG. 19. On the other hand, when the operation lever 22 is operated backwardly, the forward/reverse switching cylinder 34 is contracted to establish a power transmission path in the power transmission for reverse driving of the vehicle. When the operation lever 22 is operated toward the front left or the back left, the steering cylinder 32 is contracted to steer the front wheel 11 toward the left. Similarly, when the operation lever 22 is operated toward the front right or the back right, the steering cylinder 32 is expanded to steer the front wheel 11 toward the right.

When the ON/OFF switch 27 is held ON, the leaning cylinder 33 is operated in addition to the steering cylinder 32 in response to operation of the operation lever 22 in the left and right directions. Namely, when the operation lever 22 is operated toward the front right or the back right while the ON/OFF switch 27 is held ON, the leaning cylinder 33 is expanded to cause a rightward leaning of the front wheel 11 to permit a smaller radius right-hand turn. Similarly, when the operation lever 22 is operated toward the front left or the back left while the ON/OFF switch 27 is held ON, the leaning cylinder 33 is contracted to cause a leftward leaning of the front wheel 11 for enabling a left-hand turning of the vehicle with a smaller radius.

Figure 21:
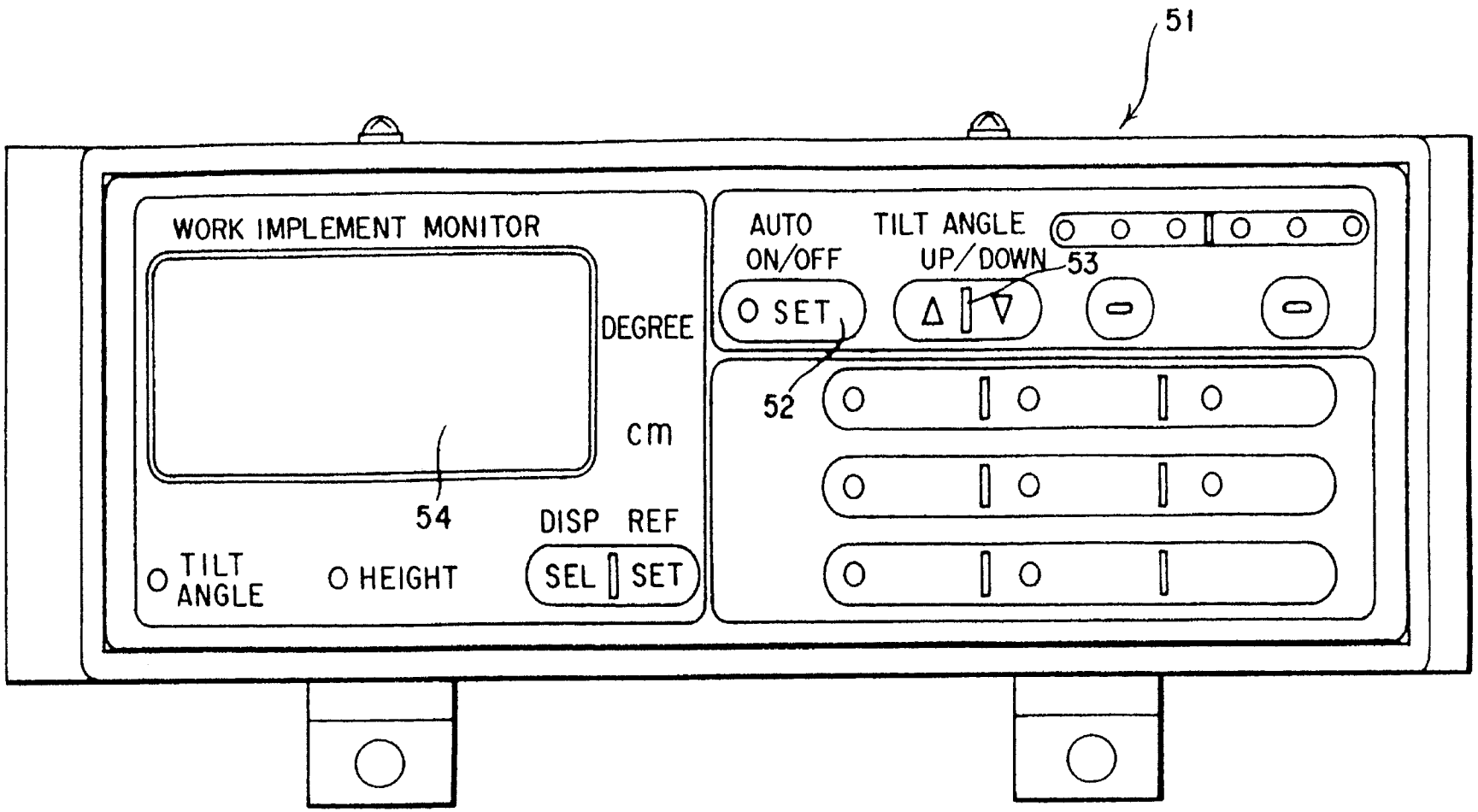
FIG. 21 is a front elevation of a display panel for setting a target blade tilt angle, which is employed in the preferred embodiment of the motor grader of the present invention.

The motor grader according to the present invention further has a feature of automatic an control of a tilt angle of the blade toward a target tilt angle. For enabling this, a display panel 51 (see FIG. 3) is provided on one side of the operator seat 21. FIG. 21 shows the detail of the display panel 51. The display panel 51 includes an automatic tilt angle control ON/OFF switch 52 for selecting an operational mode of the controller 26 between an automatic control mode and a manual control mode. The display panel 51 also includes a tilt angle setting UP/DOWN switch 53, through which the desired tilt angle of the blade 9 during automatic control mode operation can be set. During automatic control mode, the set target tilt angle is displayed on a display screen 54.

Figure 1:
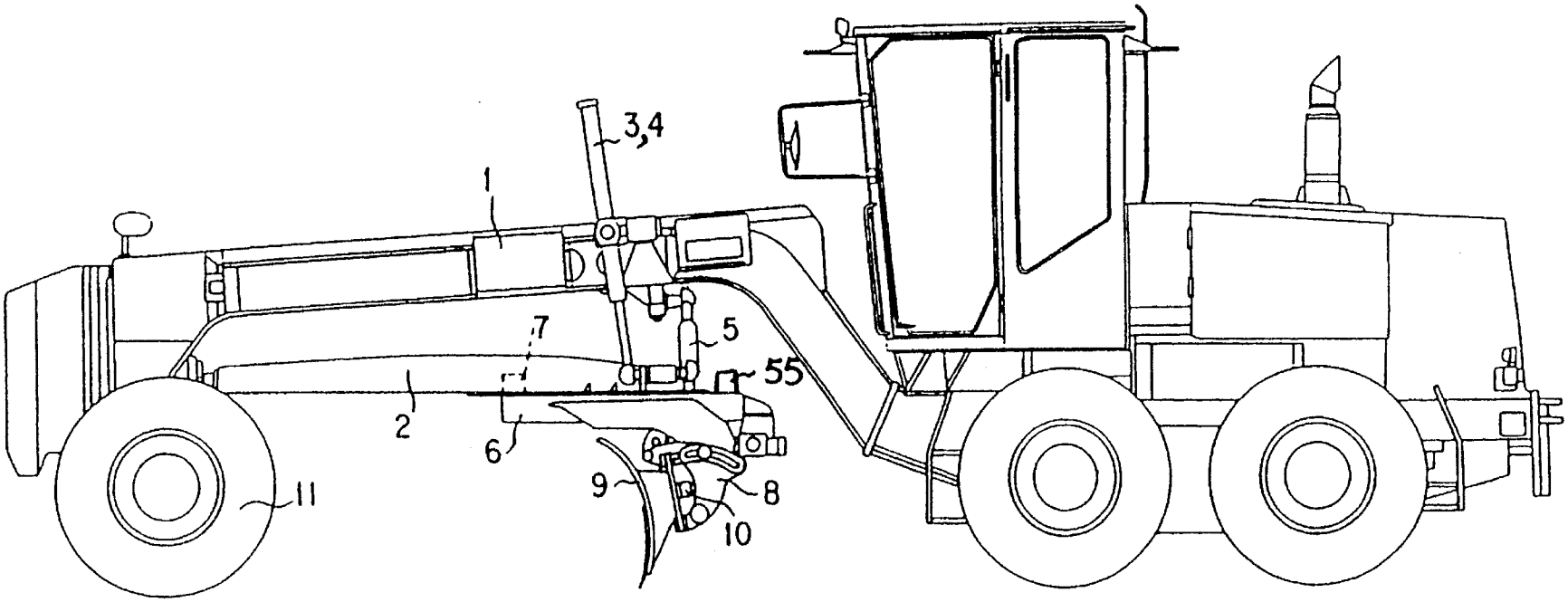
FIG. 1 PRIOR ART
FIG. 1 is a side elevation showing a general construction of a motor grader.
Figure 2:
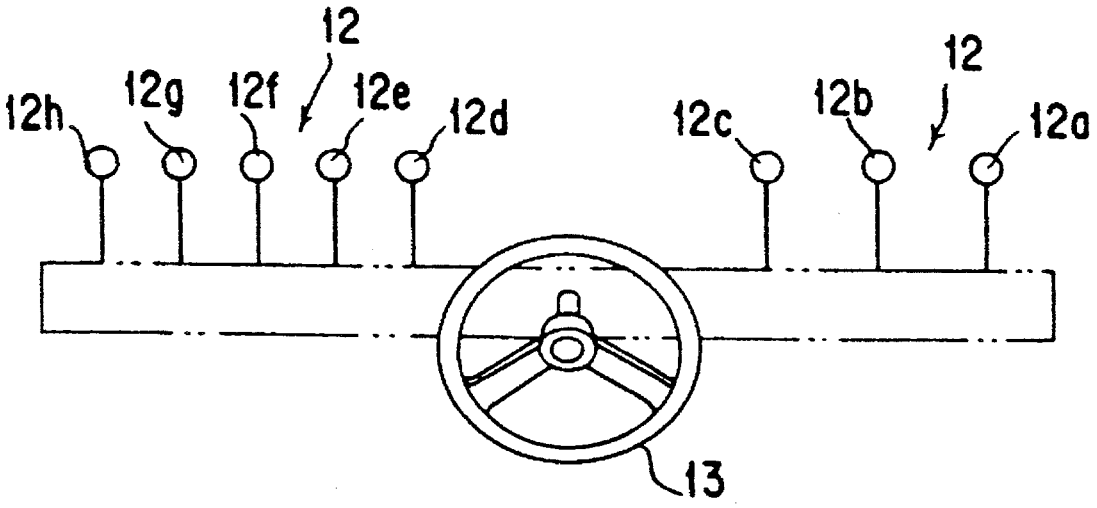
FIG. 2 PRIOR ART
FIG. 2 is a fragmentary illustration showing an example of an arrangement of operation levers in the conventional motor grader.

In an automatic control mode of operation, the controller 26 derives the expansion strokes of the left and right lift cylinders 3 and 4 in order to establish the blade tilt angle corresponding to the target tilt angle set through the display panel 51. On the other hand, the controller 26 monitors the actual tilt angle of the blade 9 on the basis of a blade tilt angle indicative signal input from a blade tilt angle sensor 55 which monitors a tilt angle of the blade in the lateral direction relative to the horizontal plan (see FIG. 1). Thus, the controller 26 may feedback control the blade tilt angle on the basis of the target tilt angle and the monitored actual tilt angle of the blade.

Also, the controller 26 derives a blade propulsion angle on the basis of the swing circle angular position indicative signal of the rotation sensor 29. On the basis of the propulsion angle and the vehicle body tilt angle indicative signal of the vehicle body tilt sensor 28, the controller 26 derives a correction value for the target blade tilt angle so that the blade tilt angle relative to the horizontal plane is maintained irrespective of variation of the propulsion angle and/or the vehicle body tilt angle.

When modification of the target blade tilt angle becomes necessary, modification of the target blade tilt angle can be performed in an interactive matter. Namely, for modifying the target blade tilt angle, the left operation lever 22*a* is operated to attain the desired tilt angle of the blade 9. Once the desired blade tilt angle is established, the operational force exerted on the left operation lever 22*a* is released. Then, the left operation lever 22*a* returns to the neutral position. In response to this, the controller 26 reads out the actual blade tilt angle from the blade tilt angle sensor 55 sets the read angle as the updated target blade tilt angle. Then, the modified blade tilt angle is displayed on the display screen 54.

With the construction set forth above, all of the objects and advantages sought for the present invention are achieved.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. An operation system for a motor grader including a plurality of hydraulic actuators for performing various functions and a plurality of valve means respectively corresponding to said actuators for controlling operation of the latter, comprising:

left and right operation levers provided within an operator cabin of the motor grader and operable in arbitrary directions for outputting operation command signals indicative of operated directions of said levers and having values proportional to an operation stroke thereof for selectively causing said various functions in a controlled magnitude depending upon said operated directions of said operation levers and said operation stroke;

a selector switch operable for selecting one of a plurality of operational modes and outputting a selection signal indicative of the selected operational mode; and a controller receiving said operation command signals from said left and right operation levers, and said selection signal from said selector switch, said controller generating operation control signals for supplying to at least one of said valve means corresponding to the operated direction represented by a corresponding operation command signal from among said operation command signals received, wherein said operation control signals are supplied to different valve means depending upon the operational mode selected based on said selection signal.

2. An operation system as set forth in claim 1, wherein said left and right operation levers are operable in a back and forth direction and a left and right direction for producing the operation command signal representative of the operated direction and having a value proportional to the operation stroke, each of said valve means comprises an electromagnetic proportioning valve, and said controller selects a work implement to be operated from among a plurality of work implements carried by said motor grader on the basis of said operation command signal and said selection signal to output said operation control signal to the corresponding valve means.

3. An operation system for a motor grader including a plurality of hydraulic actuators for performing various functions and a plurality of valve means respectively corresponding to said actuators for controlling operation of the latter, comprising:

left and right operation levers provided within an operator cabin of the motor grader and operable in arbitrary directions for outputting operation command signals indicative of the operated directions of said operation levers and having values proportional to an operation stroke thereof, said left operating lever being assigned for controlling vehicular driving functions and said right operation lever being assigned for controlling functions of work implements carried by said motor grader depending upon said operated directions and said operation stroke of said operation levers;

a selector switch operable for selecting one of a plurality of operational modes including first and second modes and outputting a selection signal indicative of the selected operational mode; and a controller receiving said operation command signals from said left and right operation levers, and said select signal from said selector switch, said controller generating an operation control signal to be supplied to at least one valve means for controlling at least one parameter associated with vehicular driving behavior in response to said operation command signal from said left operation lever and said selection signal indicative of said first mode as said selected operational mode, to another valve means for controlling another parameter associated with vehicular driving behavior in response to said operation command signal from said left operation lever and said selection signal indicative of said second mode as said selected operational mode, and for controlling one operational parameter associated with one operation of one of said work implements in response to said operation command signal from said right operation lever and said selection signal indicative of said first mode as said selected operational mode, and the other operational parameter associated with the other operation of one of work implements in response to said operation command signal from said right operation lever and said selection signal indicative of said second mode as said selected operational mode.

4. An operation system as set forth in claim 3, wherein said left and right operation levers are operable in a back and forth direction and a left and right direction for producing the operation command signal representative of the operated direction and having a value proportional to the operation stroke, each of said valve means comprises an electromagnetic proportioning valve, and said controller selects a work implement to be operated from among a plurality of work implements carried by said motor grader on the basis of said operation command signal from said right operation lever and said selection signal to output said operation control signal to the corresponding valve means.

5. A blade swing control system for a motor grader, in which a swing circle in mounted on a draw bar mounted on a vehicle body, for swing motion by means of a hydraulic swing motor, and a blade is mounted on said swing circle for lateral movement by means of a shift cylinder, comprising:

an operation lever operable at least in a back and forth direction and a left and right direction for generating an operation command signal representative of the operated direction and the magnitude of said operation command signal being variable corresponding to variation of the operation stroke thereof;

a first electromagnetic proportioning valve for controlling pressure supply for said hydraulic swing motor;

a second electromagnetic proportioning valve for controlling pressure supply for said shift cylinder;

means for detecting a swing angle of said blade;

means for deriving lateral shifting magnitude of said blade; and a controller for operating said first and second electromagnetic proportioning valves so that said hydraulic swing motor is so driven that said blade swings over an angle indicated by a swing angle command supplied through said operation lever and that said shift cylinder is so driven that said blade shifts laterally in a magnitude corresponding to said swing angel of said blade.

6. A control system for controlling a tilt angle of a blade of a motor grader, comprising:

an operation lever operable in an arbitrary direction to generate an operation command signal representative of the operated direction and the operation magnitude thereof;

left and right lifting cylinders for lifting said blade upwardly and downwardly;

means for detecting a propulsion angle of said blade;

means for setting a target blade tilt angle;

first and second electromagnetic proportioning valves for controlling a pressure supply for said left and right lift cylinders; and a controller for controlling said first and second electromagnetic proportioning valves on the basis of said target blade tilt angle and said blade propulsion angle in response to the operation of said operation lever in a first direction and for controlling said first and second electromagnetic proportioning valves for varying the tilt angle of said blade depending upon said operation command signal and updating said target blade tilt angle in response to the operation of said operation lever in a second direction different from said first direction.

7. A blade lifting control system for a motor grader including a draw bar supported on a vehicle body by means of left and right lifting cylinders for vertical swing motion, and a lateral feeding cylinder disposed between said draw bar and said vehicle body, comprising:

an operation lever operable in a back and forth direction for generating an operation command signal representative of the operated direction and the operation stroke;

a first electromagnetic proportioning valve for controlling pressure supply for said left lifting cylinder;

a second electromagnetic proportioning valve for controlling pressure supply for said right lifting cylinder;

a third electromagnetic proportioning valve for controlling pressure supply for said lateral feeding cylinder; and a controller for outputting operation control signals to said first, second and third electromagnetic proportioning valves in response to said operation command signal from said operation lever.

8. A blade lifting control system for a motor grader including a draw bar supported on a vehicle body by means of left and right lifting cylinders for vertical swing motion, and a blade being mounted on said draw bar, comprising:

an operation lever operable in a back and forth direction for generating an operation command signal representative of the operated direction and the operation stroke;

a first electromagnetic proportioning valve for controlling a pressure supply for said left lifting cylinder;

a second electromagnetic proportioning valve for controlling a pressure supply for said right lifting cylinder; and a controller for operating said first and second electromagnetic proportioning valves in response to said operation command signal from said operation lever in a mutually independent manner for establishing first and second fluid path areas in said first and second electromagnetic proportioning valves.

9. A motor grader comprising:

a wheeled body for traveling and carrying at least one work implement;

at least one operation lever operable in a first direction for electrically generating a first operation command signal and in a second direction perpendicular to said first direction for generating a second operation command signal;

a mode selector selectable at least between a first mode and a second mode for generating a mode selection signal; and a controller receiving said first and second operation command signals and said mode selection signal for controlling different motor grader functions depending upon an input combination of said first and second operation command signals and said mode selection signal, in which a first mode grader function is performed in response to said first operation command signal while said first mode is selected by said mode selection signal, a second motor grader function distinct from said first motor grader function is performed in response to said second operation command signal while said first mode is selected by said mode selection signal, a third motor grader function distinct from said first and second motor grader functions in response to said first operation command signal while said second mode is selected by said mode selection signal and a fourth motor grader function unique to said first to third motor grader functions in response to said second operation command signal while said second mode is selected.

10. A motor grader as set forth in claim 9, wherein said operation lever is further operable in further directions oblique to said first and second directions, and said controller is responsive to said operation command signal from said operation lever as operated in one of a plurality of operating directions to control one of motor grader functions unique to those to be controlled by the operation of said operation lever in any other directions.

11. A motor grader as set forth in claim 9, wherein said controller controls a first motor grader function to be performed by a first component of said motor grader in response to said first operation command signal input while said mode selection signal is held at said first mode and a second motor grader function to be performed by a second component different from said first component in response to said second operation command signal input while said mode selection signal is held at said first mode, a third motor grader function to be performed by a third component different from said first and second components in response to said first operation command signal input while said mode selection signal is held at said second mode and a fourth motor grader function to be performed by a fourth component different from said first, second and third components in response to said second operation command signal input while said mode selection signal is held at said second mode.

12. A motor grader as set forth in claim 11, wherein at least one of first, second, third and fourth motor grader functions is a composite function of a plurality of motor grader components including the corresponding one of said first, second, third and fourth components and at least one auxiliary component.

13. A motor grader as set forth in claim 12, wherein said auxiliary component cooperates with said one of said first, second, third and fourth components for compensating inherent undesirable action associated with operation of said one of the first, second, third and fourth components.

14. A motor grader as set forth in claim 13, wherein said one of the first, second, third and fourth component comprises a hydraulic motor for controlling swing motion of a blade, and said auxiliary component comprises a hydraulic cylinder for causing lateral shift of said blade for compensating lateral displacement inherently caused by swing motion of the blade.

15. A motor grader as set forth in claim 9, wherein said first function is vehicular traveling in a forward and reverse direction and second function is a vehicular steering operation.

16. A motor grader as set forth in claim 15, wherein said third function is vehicular traveling in a forward and reverse direction which is the same as said first function and said fourth function is a leaning control function.

17. A monitor grader as set forth in claim 15, wherein said third function is vehicular traveling in a forward and reverse direction which is the same as said first function and said fourth function is a vehicular body arcuation control function.

18. A motor grader as set forth in claim 9, wherein said controller is provided with a blade tilt angel adjusting function for adjusting a blade tilt angle toward a preset target tilt angle, and said controller performs the automatic control of the blade tilt angle toward said target tilt angle in response to said first operation command signal received from said operation lever while said mode selection signal is held at said first mode, and permits the interactive control of the blade tilt angle through said operation lever in response to said first operation command signal received while said mode selection is held at said second mode so as to update said target tilt angle with the manually set angle of said blade.

19. A motor as set forth in claim 18, wherein said controller also receives a first correction parameter representative of a propulsion angle of said blade for correcting said target blade tilt angle based thereon during operation in response to said first operation command input under said first mode of said mode selection signal.

20. A motor grader as set forth in claim 18, wherein said controller also receives a first correction parameter representative of a propulsion angle of said blade and a second correction parameter representative of a tilt angle of the vehicular body for correcting said target blade tilt angle based thereon during operation in response to said first operation command input under said first mode of said mode selection signal.

21. A motor grader comprising:

a wheeled body for traveling and carrying at least one work implement;

at least one operation lever operable in a first direction for electrically generating a first operation command signal and in a second direction perpendicular to said first direction for generating a second operation command signal;

a mode selector selectable at least between a first mode and a second mode for generating a mode selection signal; and a controller receiving said first and second operation command signals and said mode selection signal for controlling different motor grader functions depending upon an input combination of said first and second operation command signals and said mode selection signal, in which said controller controls a first motor grader function to be performed by a first component of said motor grader in response to said first operation command signal input while said mode selection signal is held at said first mode and a second motor grader function to be performed by a second component different from said first component in response to said second operation command signal input while said mode selection signal is held at said first mode, a third motor grader function to be performed by a third component different from said first and second components in response to said first operation command signal input while said mode selection signal is held at said second mode and a fourth motor grader function to be performed by a fourth component different from said first, second and third components in response to said second operation command signal input while said mode selection signal is held at said second mode.

* * * * *